US006188856B1

(12) United States Patent
Sato

(10) Patent No.: US 6,188,856 B1
(45) Date of Patent: Feb. 13, 2001

(54) DEVELOPING DEVICE, PROCESS CARTRIDGE, ELECTROPHOTOGRAPHIC IMAGE FORMING APPARATUS, AGITATION SUPPORT MEMBER AND AGITATING MEMBER

(75) Inventor: Minoru Sato, Toride (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/492,333

(22) Filed: Jan. 27, 2000

(30) Foreign Application Priority Data

Jan. 28, 1999 (JP) ..... 11-019387

(51) Int. Cl.[7] ..... G03G 15/08
(52) U.S. Cl. ..... 399/119; 399/254
(58) Field of Search ..... 399/119, 254, 399/255, 272, 281; 366/279

(56) References Cited

U.S. PATENT DOCUMENTS

| | | | | |
|---|---|---|---|---|
| 5,134,441 | * | 7/1992 | Nagata et al. . | |
| 5,331,373 | | 7/1994 | Nomura et al. | 355/200 |
| 5,452,056 | | 9/1995 | Nomura et al. | 355/200 |
| 5,465,140 | * | 11/1995 | Nakamura et al. . | |
| 5,528,341 | | 6/1996 | Shishido et al. | 355/200 |
| 5,585,889 | | 12/1996 | Shishido et al. | 355/200 |
| 5,710,961 | * | 1/1998 | Jeong | 399/256 |
| 5,835,827 | * | 11/1998 | Kishimoto | 399/254 |
| 5,870,654 | | 2/1999 | Sato et al. | 399/109 |
| 5,911,096 | | 6/1999 | Batori et al. | 399/111 |
| 5,940,658 | | 8/1999 | Yokio et al. | 399/119 |
| 5,966,566 | | 10/1999 | Odagawa et al. | 399/109 |
| 5,974,288 | | 10/1999 | Sato | 399/119 |
| 6,021,291 | * | 2/2000 | Karakama et al. | 399/104 |
| 6,047,141 | * | 4/2000 | Miyaoka et al. | 399/27 |
| 6,047,153 | * | 4/2000 | Kawaguchi | 399/263 |
| 6,064,844 | * | 5/2000 | Isobe et al. | 399/119 |

* cited by examiner

*Primary Examiner*—Richard Moses
(74) *Attorney, Agent, or Firm*—Fitzpatrick, Cella, Harper & Scinto

(57) ABSTRACT

A developing device for use in an electrophotographic image forming apparatus includes a developer container for containing therein a developer to be used for the development of an electrostatic latent image formed on an electrophotographic photosensitive member, a developing unit for developing the electrostatic latent image formed on the electrophotographic photosensitive member by the developer, an agitating member for agitating the developer contained in the developer container, an agitation support member for supporting the agitating member, a drive transmitting member for supporting one longitudinal end of the agitation support member on the developer container and driving the agitation support member, and a metallic support member for supporting the other longitudinal end of the agitation support member on the bearing portion of the developer container.

67 Claims, 11 Drawing Sheets

DEVELOPING DEVICE, PROCESS CARTRIDGE, ELECTROPHOTOGRAPHIC IMAGE FORMING APPARATUS, AGITATION SUPPORT MEMBER AND AGITATING MEMBER

BACKGROUND OF THE INVENTION

1. Field of the Invention

This invention relates to a developing device, a process cartridge, an electrophotographic image forming apparatus, an agitation support member and an agitating member.

Here, the "electrophotographic image forming apparatus" refers to an apparatus for forming an image on a recording medium by the use of the electrophotographic image forming process. Examples of the electrophotographic image forming apparatus include, for example, an electrophotographic copier, an electrophotographic printer (e.g. a laser printer, an LED printer or the like), a facsimile apparatus and a word processor.

Also, the "process cartridge" refers to charging means, developing means or cleaning means and an electrophotographic photosensitive member integrally made into a cartridge detachably mountable to the main body of an electrophotographic image forming apparatus. It also refers to at least one of charging means, developing means and cleaning means and an electrophotographic photosensitive member integrally made into a cartridge detachably mountable to the main body of an electrophotographic image forming apparatus. Further, it refers to at least developing means and an electrophotographic photosensitive member integrally made into a cartridge detachably mountable to the main body of an electrophotographic image forming apparatus.

2. Related Background Art

In an electrophotographic image forming apparatus using the electrophotographic image forming process, there has heretofore been adopted a process cartridge system in which an electrophotographic photosensitive drum and process means acting on this electrophotographic photosensitive drum are integrally made into a cartridge detachably mountable to the main body of the image forming apparatus. According to this process cartridge system, the maintenance of the apparatus can be done by a user himself without resorting to a serviceman and therefore, the operability of the apparatus could be markedly improved. So, this process cartridge system is widely used in image forming apparatuses.

Such a process cartridge has a developing device comprising a toner container for containing a toner (developer) therein and a developer container containing developing means therein in order to develop an electrostatic latent image formed on the electrophotographic photosensitive drum, the toner container and the developer container being coupled together and made integral with each other. An agitation support member having an agitating member, or an agitating member integrally having an agitating portion and an agitation support portion is provided in the toner container of the developing device so as to be capable of transmitting a drive force, and the toner is carried to the developing means while being agitated by the agitation support member or the agitating member.

SUMMARY OF THE INVENTION

The present invention is a further development of the above-described conventional art.

A main object of the present invention is to provide a developing device that can prevent the creation of coarse-grained developer by the sliding frictional heat of the non-driving side end portion of an agitation support member and a bearing portion supporting the non-driving side end portion of the agitation support member.

Another main object of the present invention is to provide a developing device that can prevent the creation of coarse-grained developer by the sliding frictional heat of the non-driving side end portion of the agitation support portion of an agitating member and a bearing portion supporting the non-driving side end portion of the agitation support portion.

Another main object of the present invention is to provide a process cartridge that can prevent the creation of coarse-grained developer by the sliding frictional heat of the non-driving side end portion of an agitation support member and a bearing portion supporting the non-driving side end portion of the agitation support member.

Another main object of the present invention is to provide a process cartridge that can prevent the creation of coarse-grained developer by the sliding frictional heat of the non-driving side end portion of the agitation support portion of an agitating member and a bearing portion supporting the non-driving side end portion of the agitation support portion.

Another main object of the present invention is to provide an electrophotographic image forming apparatus to which is detachably mountable a process cartridge that can prevent the creation of coarse-grained developer by the sliding frictional heat of the non-driving side end portion of an agitation support member and a bearing portion supporting the non-driving side end portion of the agitation support member.

Another main object of the present invention is to provide an electrophotographic image forming apparatus to which is detachably mountable a process cartridge that can prevent the creation of coarse-grained developer by the sliding frictional heat of the non-driving side end portion of the agitation support portion of an agitating member and a bearing portion supporting the non-driving side end portion of the agitation support portion.

Another main object of the present invention is to provide an agitation support member that can prevent the creation of coarse-grained developer by the sliding frictional heat of the non-driving side end portion of the agitation support member and a bearing portion supporting the non-driving side end portion of the agitation support member.

Another main object of the present invention is to provide an agitating member that can prevent the creation of coarse-grained developer by the sliding frictional heat of the non-driving side end portion of the agitation support portion of the agitating member and a bearing portion supporting the non-driving side end portion of the agitation support portion.

Another object of the present invention is to provide a developing device, a process cartridge, an electrophotographic image forming apparatus, an agitation support member and an agitating member that can effect development well.

Another object of the present invention is to provide a developing device, a process cartridge, an electrophotographic image forming apparatus, an agitation support member and an agitating member that, when agitating a developer, do not adversely affect the developer.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be described in detail with reference to the drawings.

Embodiment 1

In this embodiment, a laser beam printer will be described as an embodiment of an electrophotographic image forming apparatus.

Here, as the order of description, the electrophotographic image forming process of the electrophotographic image forming apparatus will first be described, and then a process cartridge and the general construction of the electrophotographic image forming apparatus using the same will be described.

Figure 16:
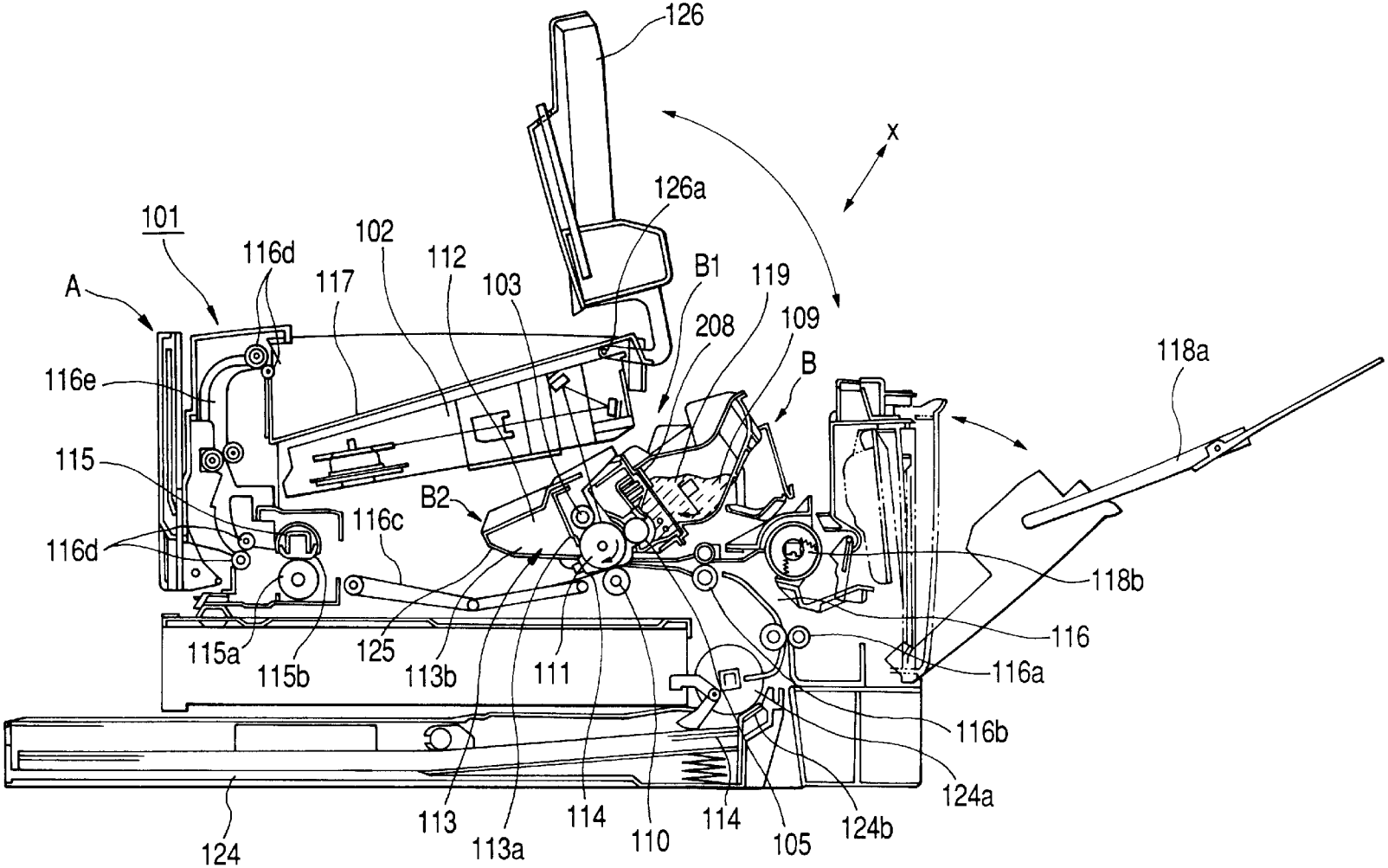
FIG. 16 is a cross-sectional view of an electrophotographic image forming apparatus.

FIG. 16 schematically shows the construction of the electrophotographic image forming apparatus (laser beam printer) according to the present embodiment.

{Description of the Electrophotographic Image Forming Process}

In FIG. 16, the reference numeral 101 designates the main body of the elec-trophotographic image forming apparatus (hereinafter referred to as the "main body of the apparatus") which is the printer engine of the electrophotographic image forming apparatus (laser beam printer) A. The reference numeral 111 denotes a drum-shaped electrophotographic photosensitive member (hereinafter referred to as the "photosensitive drum") rotatable in one direction about the drum shaft thereof. The photosensitive drum 111 has its surface uniformly charged by a charging roller 103, which is a charging device, whereafter an electrostatic latent image is formed thereon by an exposing device 102.

Figure 18:
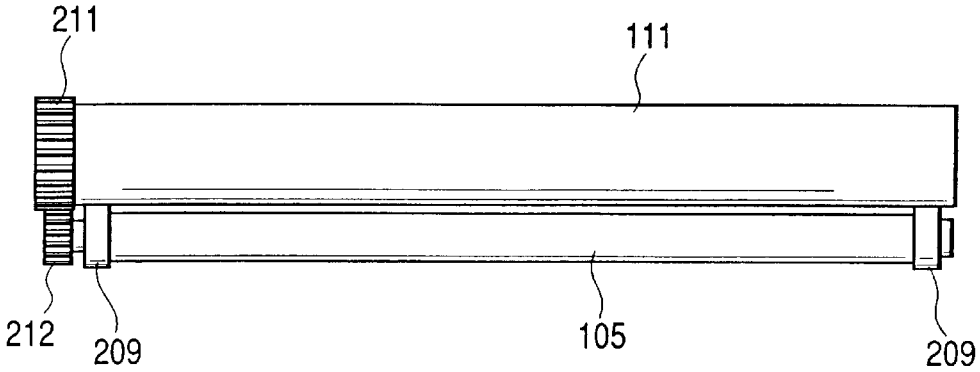
FIG. 18 is an illustration representing the positional relation between the developing sleeve of the developing device and a photosensitive drum.

The reference numeral 208 designates a developing device. The developing device 208, as shown in FIG. 18, has rollers 209 provided on the opposite end portions of a developing sleeve 105, and the rollers 209 contact with the photosensitive drum 111, whereby a predetermined gap is provided between the developing sleeve 105 and the photosensitive drum 111. The developing sleeve 105 receives a drive force from a photosensitive drum gear 211 provided on an end portion of the photosensitive drum 111 by a developing sleeve gear 212 and is rotated thereby. A toner (developer) 109 applied onto the developing sleeve 105 flies onto the photosensitive drum 111 in a developing area as soon as a bias is applied to the developing sleeve 105 through a sliding contact, not shown, and visualizes the electrostatic latent image formed on the photosensitive drum 111. By an engine control portion, not shown, provided with a power source for driving the image forming apparatus A and a high voltage circuit for supplying a bias for forming an image, a developing bias comprising an AC bias superimposed on a DC bias may be imparted to between the photosensitive drum 111 and the developing sleeve 105.

The image on the photosensitive drum 111 visualized by the toner 109 is transferred to a transfer material, 114 as a recording material such as recording paper or an OHP sheet by a transfer device 110. The transfer material 114 is contained in a cassette 124, is fed by a feed roller 116, is synchronized with the image on the photosensitive drum 111 by a registration roller **116*b* and is sent to a transfer device 110**.

The visible image by the toner 109 transferred to the transfer material 114 by the transfer device 110 is conveyed to a fixing device 115 with the transfer material 114, and is fixed onto the transfer material 114 by heat or pressure and becomes a recorded image.

On the other hand, any toner 109 not transferred but remaining on the photosensitive drum 111 after the transfer is removed by a cleaning blade **113*a* in a cleaning device 112**.

The surface of the photosensitive drum 111 from which the toner 109 has been removed is charged again by the charging roller 103, and the above-described electrophotographic image forming process is repeated.

{General Construction of the Electrophotographic Image Forming Apparatus}

The electrophotographic image forming apparatus (laser beam printer) A according to the present embodiment applies information light based on image information from the exposing device (optical system) 2 to the photosensitive drum 111 to thereby form a latent image on the photosensitive drum 111, and develops this latent image by the toner 109 to thereby form a toner image. In synchronism with the formation of this toner image, the transfer materials 114 contained in the cassette 124 are separated and fed, one by one, by a pickup roller 124*a* and a pressure-contacting member 124*b*, which is in pressure contact with the pickup roller. The transfer material 114 is conveyed by conveying means 116 comprising the feed roller 116*a,* the registration roller 116*b*, etc., and the toner image, formed on the photosensitive drum 111 made into a process cartridge B, is transferred to the transfer material 114 by a voltage being applied to the transfer roller 110 as the transfer device, and the transfer material 114 is conveyed to the fixing device 115 by a conveying belt 116*c*. This fixing device 115 comprises a driving roller 115*a* and a fixing rotary member 115*b* formed by a cylindrical sheet containing a heater therein and rotatably supported by a support member, and applies heat and pressure to the passing transfer material 114 to thereby fix the transferred toner image. This transfer material 114 may be conveyed by discharge rollers 116*d* and discharged to a discharge portion 117 through a surface reverse conveying path 116*e*. This image forming apparatus A also enables manual feeding to be effected by a manual feeding tray 118*a* and a manual feeding roller 118*b*.

{Construction of the Process Cartridge}

On the other hand, the process cartridge B is provided with the electrophotographic photosensitive member and at least one process means. This process means is, for example, charging means for charging the electrophotographic photosensitive member, developing means for developing the latent image formed on the electrophotographic photosensitive member, cleaning means for removing the toner residual on the surface of the electrophotographic photosensitive member, or the like.

The process cartridge B according to the present embodiment is such that as shown in FIG. 16, the photosensitive drum 111, which is an electrophotographic photosensitive member having a photoconductive layer, is rotated and a voltage is applied to the charging roller 103, which is charging means (charging device) to thereby uniformly charge the surface of the photosensitive drum 111. This charged photosensitive drum 111 is exposed to an optical image from the exposing device 102 through an exposure opening portion, not shown, to thereby form an electrostatic latent image, which is developed by developing means 119.

Figure 17:
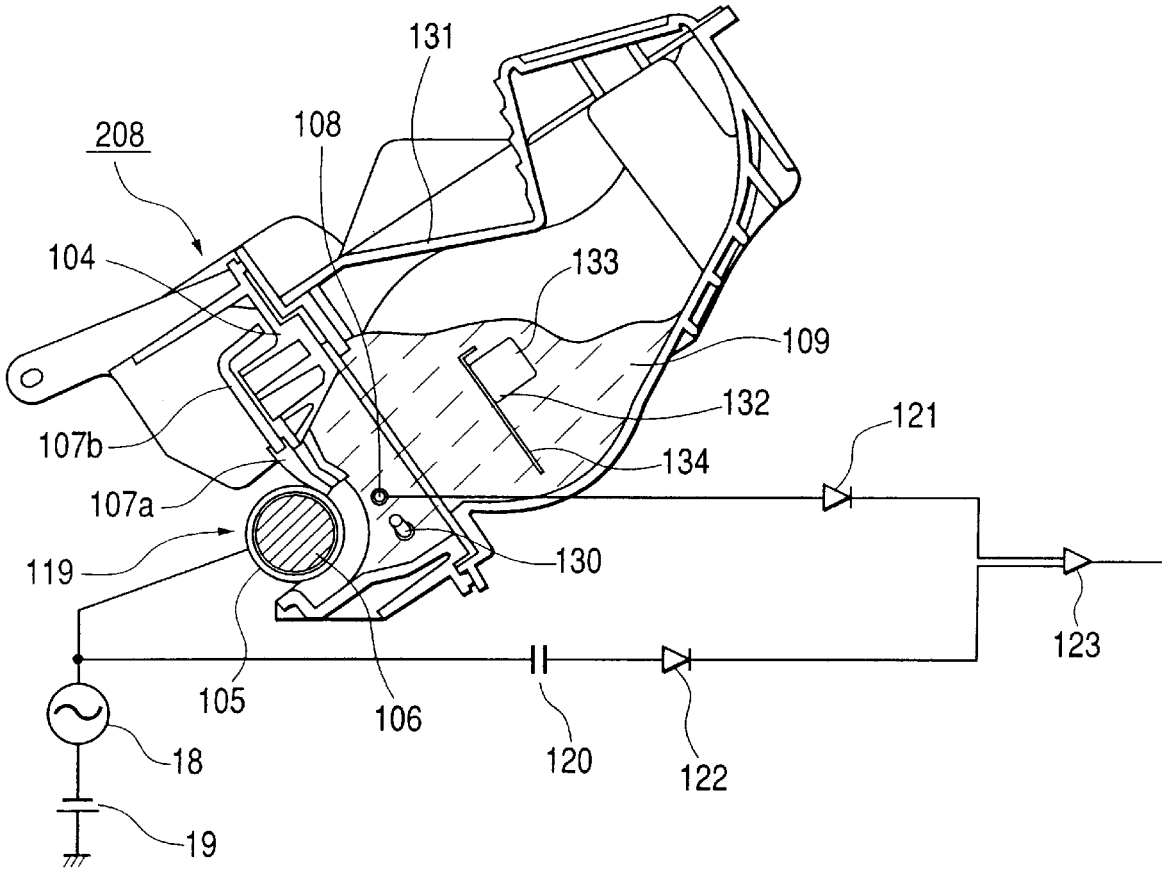
FIG. 17 is a cross-sectional view of a developing device.

The developing means 119, as shown in FIG. 17, feeds out the toner 109 in a toner container (developer container) 131 to the opening portion of the toner container 131 by a rotatable toner feeding member 132, which is toner feeding means, and feeds the toner into a development container 104 through the opening portion of the development container 104. This toner is then agitated by an agitating member 130, and the developing sleeve 105, as a developer bearing member containing a stationary magnet 106 therein, is rotated and a toner layer, having triboelectrification charge imparted thereto by an elastic blade, 107*a* as a developing blade is formed on the surface of the developing sleeve 105, and the toner thereof is shifted to the photosensitive drum 111 in conformity with the aforementioned latent image to thereby form and visualize a toner image.

A voltage opposite in polarity to the toner image is applied to the transfer roller 110 shown in FIG. 16 to thereby transfer the toner image to a recording medium 2, whereafter any toner residual on the photosensitive drum 111 is scraped off by the cleaning blade 113*a* and is dipped by a dip sheet (not shown), and the residual toner on the photosensitive drum 111 is removed by cleaning means 113 for collecting the toner into a removed toner reservoir 113*b* in a cleaning container 125.

The process cartridge B according to the present embodiment is comprised of the cleaning device 112 comprising the charging roller 103, the cleaning means 113 and the photosensitive drum 111 disposed in the cleaning container 125 and made into a unit, and the developing device 208 comprising the development container 104 and the toner container 131 coupled together and made into a unit. The cleaning device 112 and the developing device 208 are integrally coupled together by a coupling member, not shown, to thereby constitute the process cartridge B.

This process cartridge B is detachably mounted to cartridge mounting means, not shown, provided in the main body 101 of the apparatus. This process cartridge B is detachably mountable to the main body 101 of the apparatus by an operator.

The cartridge mounting means is such that when an openable and closable member 126 is opened about a shaft 126*a* shown in FIG. 16, the space of a cartridge mounting portion appears and cartridge mounting guides (not shown) are disposed on the right and left of that space. The cartridge mounting guides guide the guides provided on the right and left outer sides of the process cartridge B, and the process cartridge B is mounted to and dismounted from the main body 101 of the apparatus in the direction of arrow X.

(Construction of the Developing Device)

The construction of the developing device 208 shown in the present embodiment will now be described with reference to FIG. 17.

The developing device 208, as shown in FIG. 17, is comprised of a toner container 131 containing the toner 109 therein and provided with the toner feeding member 132 for the toner 109, and the development container 104 provided with developing means 119, the toner container 131 and the development container 104 being integrally coupled together.

The developing sleeve 105 of the developing means 119 is a non-magnetic developing sleeve as a developer bearing member formed by a pipe of aluminum or stainless steel, and a magnet 106 having magnetic poles N and S alternately formed is disposed therein immovably relative to the developing sleeve 105. The surface of the developing sleeve 105 is worked to appropriate surface roughness so as to be capable of carrying a desired amount of toner. At a location on the developing sleeve 105, an elastic blade 107*a* of e.g. urethane rubber or silicone rubber or the like as a developer regulating member is fixed to a support metal plate 107*b,* and the elastic blade 107*a* bears against the developing sleeve 105 with predetermined pressure. The amount of toner 109 attracted to the developing sleeve 105 by a magnetic force is regulated to become a suitable amount by the triboelectrification by being carried on the developing sleeve 105 and the elastic blade 107*a* portion, whereafter appropriate charge is imparted thereto by the triboelectrification by being rubbed between the developing sleeve 105 and the elastic blade 107*a*, and the toner is carried to a developing area.

The developing device will be described in greater detail.

The developing sleeve 105 is a non-magnetic aluminum sleeve having a diameter of 16 mm, and has its surface coated with a resin layer containing electrically conductive particles to effect the carrying of the toner and the imparting of triboelectricity, and the surface roughness thereof is usually average 0.4 μm to 3.5 μm in terms of JIS Ra. In the present embodiment, a sleeve of average Ra 0.95 μm is used. A magnet roll 106 having four poles is disposed in the developing sleeve 105. As the developer regulating member, silicone rubber having JIS hardness of the order of 40° is used so that the abutting force against the developing sleeve 105 may be 20–40 gf/cm (abutting load per 1 cm with respect to the longitudinal direction of the sleeve).

As the toner 109, use is made of a negatively chargeable and magnetic monocomponent toner. As the components thereof, 100 parts by weight of styrene n-butyl acrylate copolymer as binder resin, 80 parts by weight of magnetic material particles, 2 parts by weight of negative charge control agent of monoazo iron complex and 3 parts by weight of polypropylene of low molecular weight as wax are melted and kneaded by a two-axis extruder heated to 140° C., and the cooled kneaded materials are roughly pulverized by a hammer mill, and the roughly pulverized materials are finely pulverized by a jet mill, and the thus obtained finely pulverized materials are air-classified to thereby obtain classified powder of weight average diameter 5.0 μm. 1.0 part by weight of hydrophobic silica fine powder is mixed with the classified powder of average particle diameter 5.0 μm by a Henschel mixer to thereby obtain a developer. Use is made of a developer whose weight-average particle diameter is within the range of 3.5 to 7.0 μm (chiefly the order of 6 μm). In the developing device 208 of the above-described construction, the coating amount of the toner 109 on the developing sleeve 105 is of the order of 0.5 to 2.0 mg/cm$^2$.

The developing bias applied to the developing sleeve 105 is a DC voltage of −500 V and an AC voltage of rectangular wave Vpp=1600 V and frequency 2200 Hz when for example, the gap between the photosensitive drum 111 and the developing sleeve 105 is of the order of 300 μm. The charging potential of the photosensitive drum 111 is Vd=−600 V, and the potential of the laser exposing portion is Vl=−1500 V. Thereby, the portion Vl is reversal-developed.

As remaining toner-amount detecting means in such a developing device 208, in the present embodiment, use is made of means using an antenna member 108 disposed parallel to the developing sleeve 105 to detect a variation in a current induced in the antenna member 108 by an AC developing bias by the utilization of a variation in impedance by the amount of toner between the developing sleeve 105 and the antenna member 108 to thereby estimate the amount of remaining toner. The developing bias comprises an AC power supply 18 and a DC power supply 19, and as already described, the bias is supplied to the developing sleeve 105. The means for detecting the current induced in the antenna member 108 comprises members 120 to 123. The reference numeral 120 designates a capacitor having an electrostatic capacity equal to that when the toner is absent, and this capacity and the electrostatic capacity detected from the antenna member 108 are passed through diodes 121 and 122, respectively, and thereafter are compared with each other by a comparator 123 to thereby judge the presence or absence of the toner.

When the detection of the amount of remaining toner is effected, the antenna member 108 disposed in the longitudinal direction in the development container 104 may sometimes act to hamper the movement of the toner. Particularly, below the antenna member 108, a wall of the toner is liable to be formed between the lower portion of the development container 104 and the antenna member 108. Therefore, in the present embodiment, an agitating member 130 is provided between the lower portion of the development container 104 and the antenna member 108, and a method of smoothing the supply of the toner to the developing sleeve 105 while loosening the toner 109 is adopted.

(Construction of the Toner Agitating Mechanism)

The construction of the toner agitating mechanism provided in the toner container 131 will now be described with reference to FIGS. 17, 19, 20 and 21.

The toner feeding member 132 for supplying and agitating the toner 109 from the toner container 131 to the development container 104 has an agitation support member 133 made of plastic and rotatably supported in the toner container 131, and one end of a sheet-like elastic sheet member 134 as an agitating member is fixed to this agitation support member 133.

Figure 19:
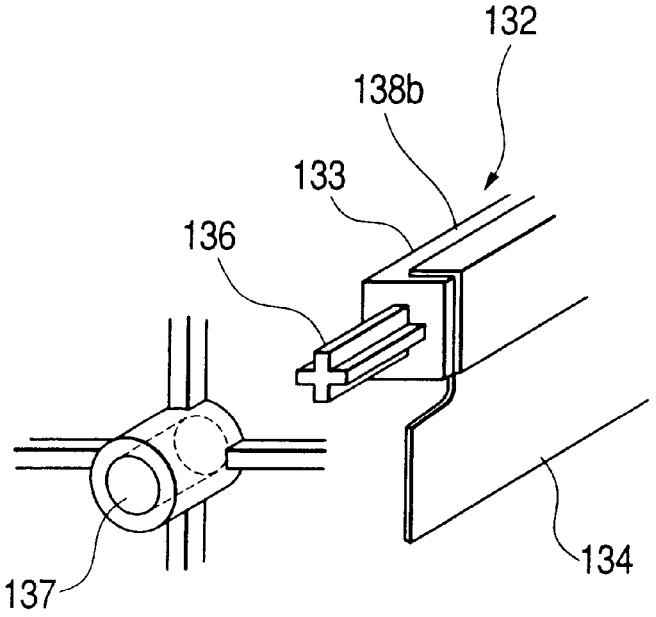
FIG. 19 is a non-driving side illustration showing an example of the construction of the toner agitating mechanism of the developing device.
Figure 20:
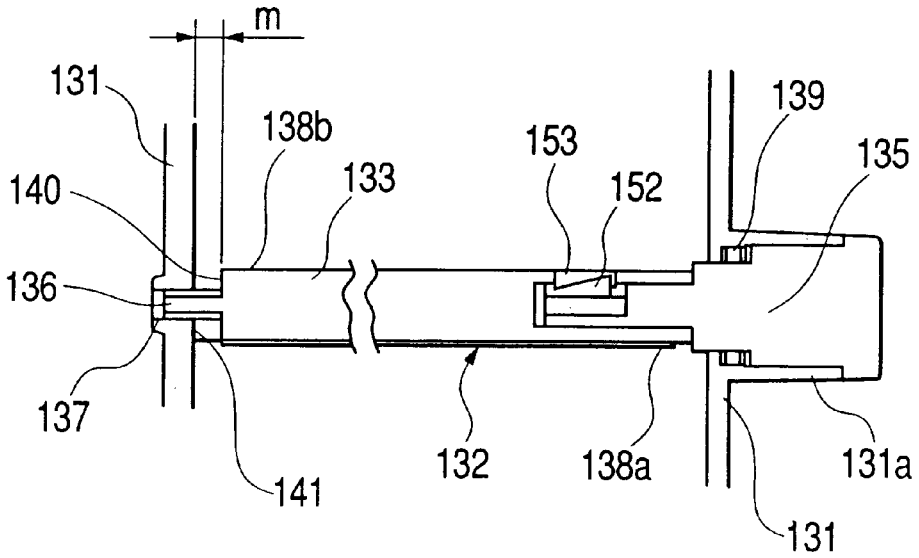
FIG. 20 is a cross-sectional view showing an example of the construction of the toner agitating mechanism of the developing device.
Figure 21:
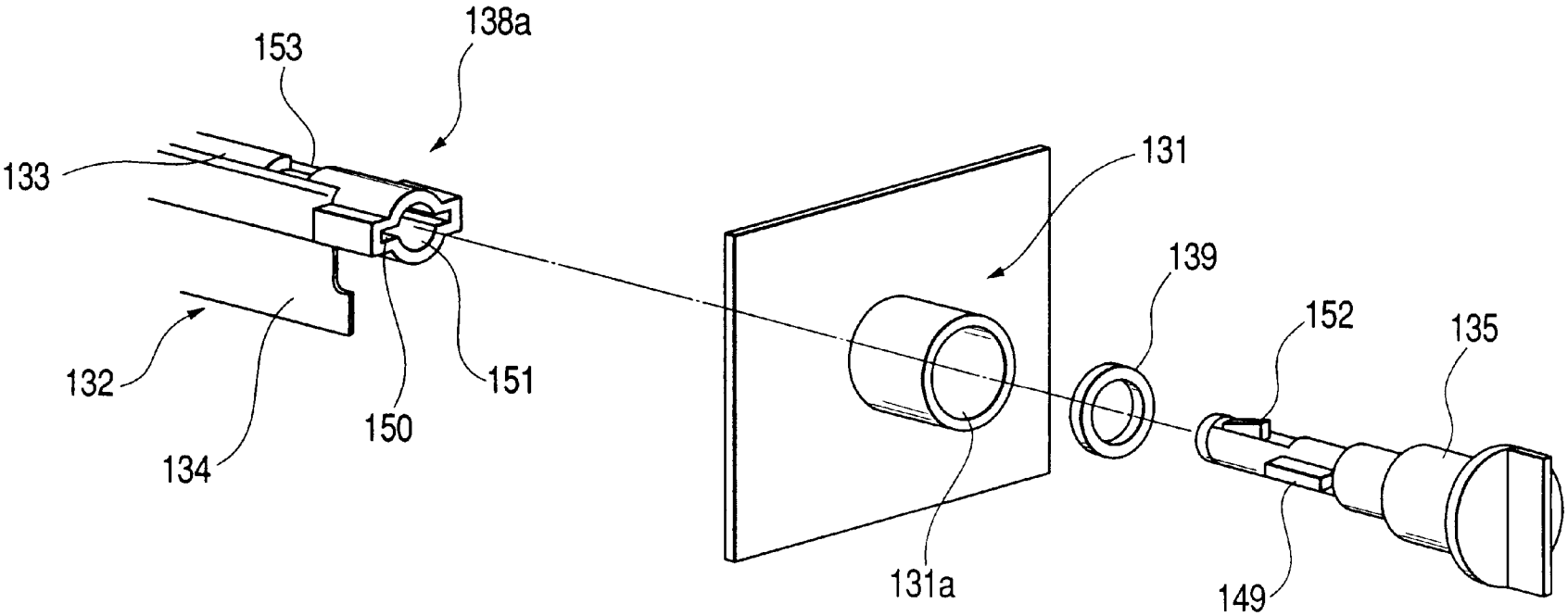
FIG. 21 is a driving side illustration showing an example of the construction of the toner agitating mechanism of the developing device.

A transmitting shaft 135 as a drive transmitting member for transmitting a drive force to the agitation support member 133, as shown in FIGS. 20 and 21, is fitted in a fitting hole 151 provided in one end portion 138*a* fitted to the toner container 131 and an annular seal member 139 and provides the driving side of the agitation support member 133. More particularly, the transmitting shaft 135 is fitted in a cylindrically shaped bearing hole 131*a* in the toner container 131 and is fitted to the seal member 139 in the bearing hole 131*a*. In the fitting hole 151 of the agitation support member 133, a longitudinal position regulating claw 152 on the tip end side of the transmitting shaft 135 is restrained in the dashing aperture portion 153 of the agitation support member 133, and the projection-like drive transmitting portion 149 of the transmitting shaft 135 is fitted in the keyway portion 150 of the agitation support member 133. The other end portion 138*b* on the non-driving side of the agitation support member 133, as shown in FIGS. 19 and 20, enters a bearing portion 137 in which a plastic support shaft 136 formed integrally with the agitation support member 133 is provided through the toner container 131 or in a bag-like shape.

The agitation support member 133 rotatably supported in the toner container 131 by the transmitting shaft 135 and the support shaft 136 is rotated about a rotational axis linking the centers of the transmitting shaft 135 and support shaft 136 on the longitudinally opposite ends together when a drive force is transmitted to the transmitting shaft 135. Thereby, the elastic sheet member 134 is rotated with the agitation support member 133 to thereby agitate and carry the toner 109 in the toner container 131 from the toner container 131 to the development container 104.

As a method of driving the toner feeding member 132, for example, the drive is reduced to a suitable rotating speed by a gear train from the drive source of the developing sleeve 105 and is transmitted to the transmitting shaft 135 to thereby drive the toner feeding member 132.

(Measure for Preventing the Creation of Coarse-grained Toner)

Now, in recent years, in the electrophotographic image forming apparatus, particularly the printing speed tends to increase and therefore, the toner agitating speed (the rotating speed of the toner feeding member 132) also tends to increase. When the toner agitating speed increases, on the support shaft 136 of the non-driving side end portion of the agitation support member 133 and the bearing portion 137 of the toner container 131 (see FIG. 20), the toner 109 may be melted and secured by the frictional heat by the sliding of the support shaft 136 relative to the bearing portion 137 of the toner container 131 and may become coarse-grained toner.

The toner 109 may also be melted and secured by the frictional heat by the sliding of the non-driving side end surface 140 of the agitation support member 133 and the inner wall surface 141 of the toner container 131 opposed to this non-driving side end surface 140, and coarse-grained toner may be created.

So, in the present embodiment, in order to prevent the creation of the coarse-grained toner by the sliding frictional heat of the support shaft 136 of the agitation support member 133 and the bearing portion 137 of the toner container 131, a support member made of a metal higher in heat conductivity than the agitation support member 133 made of plastic is used as the support shaft 136 of the non-driving side end portion of the agitation support member 133.

Figure 1:
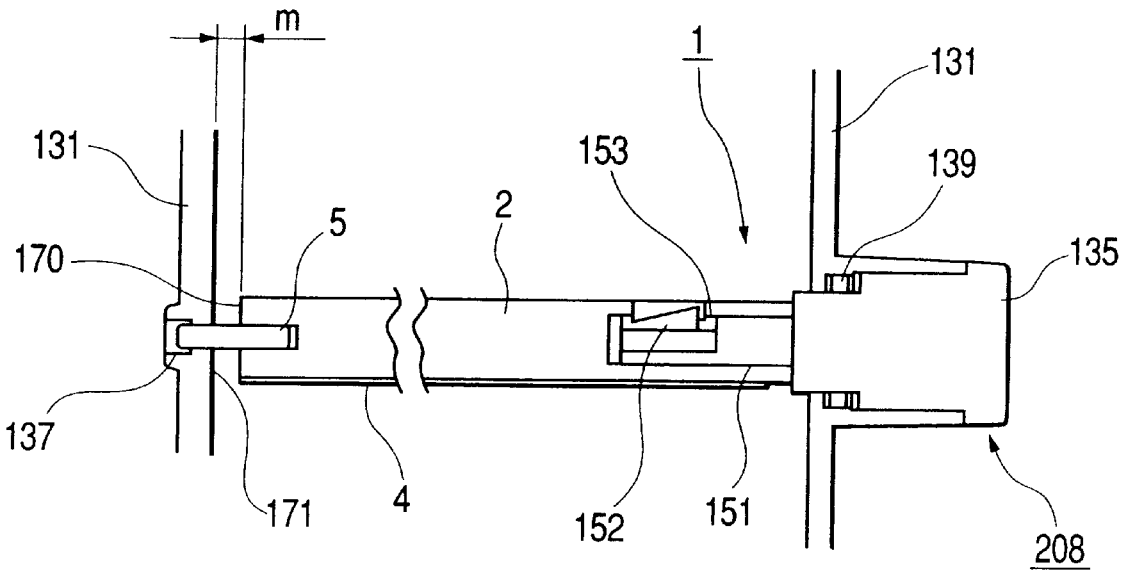
FIG. 1 is a cross-sectional view showing the construction of a toner agitating mechanism in a developing device according to Embodiment 1 of the present invention.
Figure 2:
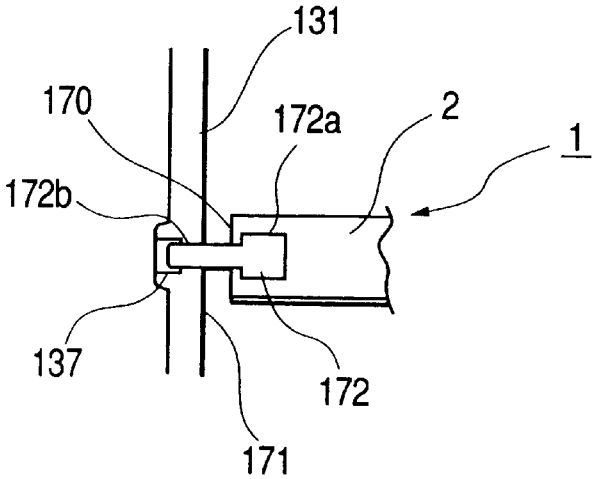
FIG. 2 is a cross-sectional view of the nondriving side end portion of an agitation support member and the bearing portion of a toner container showing a modification of the toner agitating mechanism shown in FIG. 1.
Figure 3:
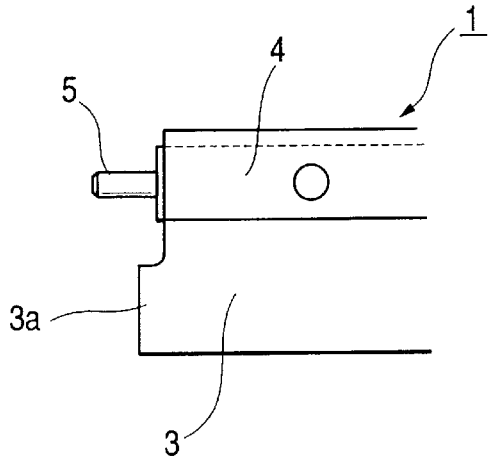
FIG. 3 is a front view of the non-driving side end portion of the agitation support member showing a modification of the toner agitating mechanism shown in FIG. 1.

FIGS. 1, 2 and 3 show the construction of a toner feeding member 1 having a support member made of a metal on the non-driving side end portion of the agitation support member 133.

In FIGS. 1, 2 and 3, the reference numeral 2 designates an agitation support member formed of a plastic material (such as polystyrene, acryl nitrile butadiene polymer or polycarbonate). One end of an elastic sheet member 3 as an agitating member is held by a support plate 4 along the longitudinal direction thereof and is fixed to the agitation support member 2.

A parallel pin 5 made of a metal (such as stainless steel or copper) as a support member is forced into and fixed to one lengthwise end portion, which is the non-driving side of the agitation support member 2. The pin shaft of this parallel pin 5 is supported by a bearing portion 137 provided in a toner container 131. Also, on another longitudinal end portion, which is the driving side of the agitation support member 2, a transmitting shaft 135 as a drive transmitting member enters from outside the toner container 131 into a fitting portion comprising a fitting hole 151 for the agitation support member 2 and a drive transmitting keyway 150. Also, on the driving side of the agitation support member 2, a snap-fit pawl 152 provided on the transmitting shaft 135 is restrained in the abutting aperture portion 153 of the agitation support member 2 to thereby regulate the lengthwise position of the agitation support member 2. Thereby, on the non-driving side of the agitation support member 2, there is secured a predetermined gap m (0.5 mm or greater) in which the non-driving side end surface 170 of the agitation support member 2 and the inner wall surface 171 of the toner container 131 around the bearing portion thereof do not frictionally contact each other and the non-driving side end surface 170 of the agitation support member 2 and the inner wall surface 171 of the toner container 131 do not frictionally contact each other even if the tolerance of the parts is accumulated.

In the developing device 208 of such a construction, a driving force is transmitted from the aforedescribed gear train of the process cartridge B to the transmitting shaft 135 of the toner feeding member 1, and the transmitting shaft 135 transmits the driving force to the agitation support member 2. Thereby, the elastic sheet member 3 is rotated in the toner container 131 about a rotational axis passing through the centers of the parallel pin 5 on the non-driving side and the transmitting shaft 135 on the driving side, thereby agitating and carrying the toner 109 in the toner container 131 from the toner container 131 to the development container 104.

During the agitation and carrying of the toner 109 by the elastic sheet member 3, the parallel pin 5 rotatively slides by receiving the driving force in the bearing portion 137 of the toner container 131 by the transmitting shaft 135 with the agitation support member 2, and generates heat. However, the parallel pin 5 is high in heat conductivity as compared with the agitation support member 2 made of resin (plastic) and therefore, efficiently radiates the sliding frictional heat with the bearing portion 137 of the toner container 131. Therefore, the parallel pin 5 does not experience a temperature rise that would melt and secure the toner 109 present near the bearing portion 137. Accordingly, the creation of coarse toner particles by the sliding frictional heat of the parallel pin 5 relative to the bearing portion 137 of the toner container 131 can be prevented.

Also, the parallel pin 5 secures a predetermined gap m between the non-driving side end surface 170 of the agitation support member 2 and the inner wall surface 171 of the toner container 131, and is supported by the bearing portion 137 of the toner container 131. Therefore, the non-driving side end surface 170 of the agitation support member 2 does not slide relative to the inner wall surface 171 of the toner container 131, whereby the creation of coarse-grained toner by the sliding frictional heat between the non-driving side end surface 170 of the agitation support member 2 and the inner wall surface 171 of the toner container 131 can be prevented.

In this construction, an experiment was actually carried out under the following conditions:

container side bearing:
- high-impact styrene resin (HIPS material) non-driving side support shaft:
- stainless steel (SUS) and the same HIPS material as the container agitation rotational speed:
- 18.16 rpm (off-axial peripheral speed 1.9 mm/sec.)

duration environment: 40° C. 80% R.H.

duration time: 40H toner used: average particle diameter about 6 $\mu$m

As the result, in an agitating construction using the HIPS material as the support shaft, there were found several tens of coarse grains securing to over 100 $\mu$m and clogging between the developing blade and the developing sleeve, but in the agitating mechanism using SUS for the support shaft, coarse grains could hardly be found. From this, it was confirmed that the construction of the present embodiment was superior.

Thus, the developing device 208 of the present embodiment can prevent the creation of coarse-grained toner in the developing step of the electrophotographic image forming process. Accordingly, the creation of a defective image in which coarse-grained toner is held between the elastic blade 107*a* and the developing sleeve 105 and that portion becomes a blank area in which the toner 109 is absent in the image can be prevented, and good image formation can be accomplished.

Also, as shown in FIG. 1, a predetermined gap m is secured between the non-driving side end surface 170 of the agitation support member 2 and the inner wall surface 171 of the toner container 131 and therefore, on the non-driving side of the agitation support member 2, there can be provided a shape in which the end portion 3*a* of the elastic sheet member 3 can be brought close to the vicinity of the inner wall surface 171 of the container (see FIG. 3). Thereby, the agitating and carrying force for the toner 109 in the inner end portion of the toner container on the non-driving side of the agitation support member 2 can be prevented from being reduced.

In the developing device 208 shown in the present embodiment, the parallel pin 5 is forced into and fixed to the agitation support member 2, but as shown in FIG. 2, instead of the parallel pin 5, a construction in which a stepped pin 172, which is a metallic support member, is insert-molded in the agitation support member 2, may be adopted. In this case, the stepped pin 172 has its large-diametered portion 172*a* fixed to the agitation support member 2 and has its small-diametered portion 172*b* supported by the bearing portion 137 of the toner container 131.

In the developing device 208 of such a construction, the stepped pin 172 receives a driving force from the transmitting shaft 135 by the bearing portion 137 of the toner container 131 with the agitation support member 2 and rotatively slides, and generates heat. The stepped pin 172, however, is high in heat conductivity as compared with the agitation support member 2 made of resin (plastic) and therefore efficiently radiates the sliding frictional heat with the bearing portion 137 of the toner container 131. Therefore, the stepped pin 172 does not rise to such a temperature that melts and secures the toner 109 present near the bearing portion 137. Accordingly, the creation of coarse-grained toner by the sliding frictional heat of the small-diametered portion 172*b* of the stepped pin 172 relative to the bearing portion 137 of the toner container 131 shown in FIG. 17 can be prevented.

Also, the stepped pin 172, as shown in FIG. 2, has its small-diametered portion 172*b* supported by the bearing portion 137 of the toner container 131 to thereby secure the predetermined gap m between the non-driving side end surface 170 of the agitation support member 2 and the inner wall surface 171 of the toner container 131. Thereby, the creation of coarse-grained toner by the sliding frictional heat of the non-driving side end surface 170 of the agitation support member 2 and the inner wall surface 171 of the toner container 131 can be prevented.

Again in the developing device 208 wherein the metallic stepped pin 172 is thus fixed to the non-driving side end portion of the agitation support member 2, the creation of coarse-grained toner can be prevented at the developing step of the electrophotographic image forming process. Accordingly, the creation of a defective image in which coarse-grained toner is held between the elastic blade 107*a* shown in FIG. 17 and the developing sleeve 105 causing that portion to become a blank area in which the toner 109 is absent on the image can be prevented, and good image formation can be accomplished.

Also, as described above, the predetermined gap m is secured between the non-driving side end surface 170 of the agitation support member 2 and the inner wall surface 171 of the toner container 131 and therefore, on the non-driving side of the agitation support member 2, there can be provided a shape in which the end portion 3*a* of the elastic sheet member 3 is brought close to the vicinity of the inner wall surface 171 of the toner container (see FIG. 3). Thereby, on the non-driving side of the agitation support member 2, the carrying and agitating capability of the elastic sheet member 3 for the toner 109 can be prevented from being reduced.

Accordingly, when the toner feeding member 1 is constructed by the use of the stepped pin 172, an effect similar to that of the toner feeding member 1 using the above-described parallel pin 5 can also be obtained.

Embodiment 2

A developing device according to Embodiment 2 of the present invention will now be described.

The developing device according to the present embodiment is the same in construction as the developing device according to the aforedescribed Embodiment 1 except for the toner feeding member. Accordingly, the developing device according to the present embodiment, like the developing device according to the aforedescribed Embodiment 1, is integrally coupled to a cleaning device to thereby constitute a process cartridge. This process cartridge is detachably mountable to the cartridge mounting means of the main body of the apparatus.

Figure 4:
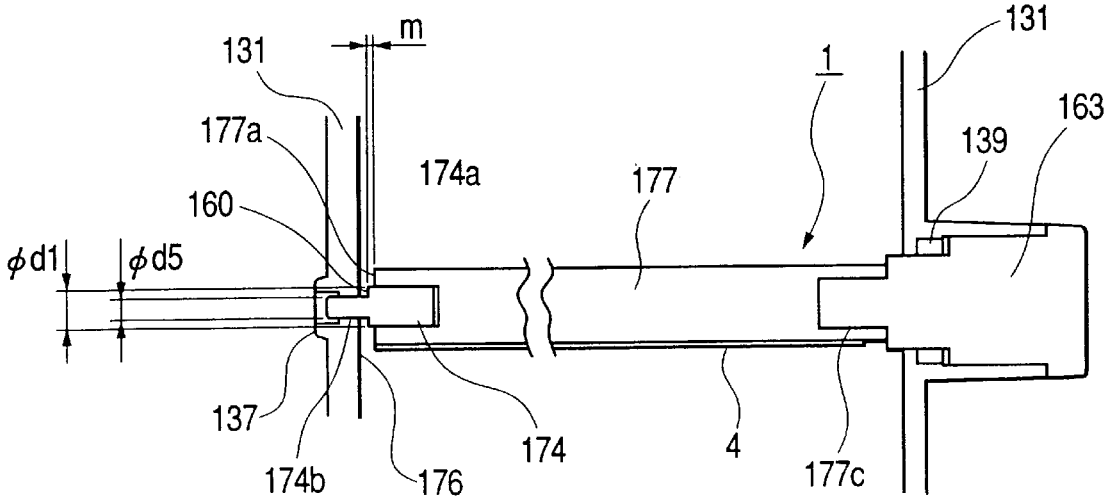
FIG. 4 is a cross-sectional view showing the construction of a toner agitating mechanism in a developing device according to Embodiment 2 of the present invention.
Figure 5:
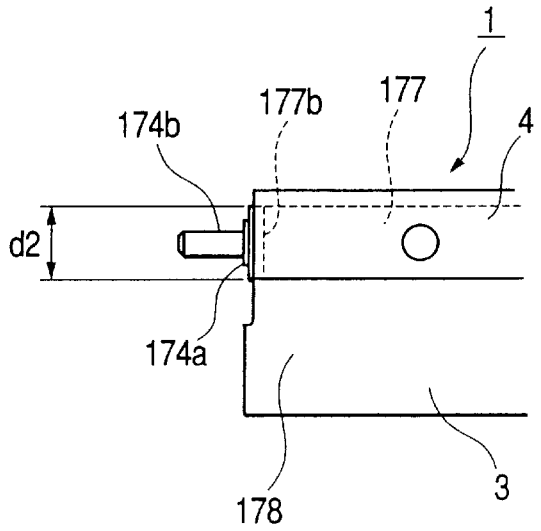
FIG. 5 is a front view of the non-driving side end portion of the agitation support member of the toner agitating mechanism shown in FIG. 4.

FIGS. 4 and 5 show the construction of a toner feeding member in the developing device according to the present embodiment.

In the developing device 208 according to the aforedescribed Embodiment 1, in order to prevent the creation of coarse-grained toner by the sliding friction between the non-driving side end surface 170 of the agitation support member 2 and the inner wall surface 171 of the toner container 131, the predetermined gap m is secured between the non-driving side end surface 170 of the agitation support member 2 and the inner wall surface 171 of the toner container.

In the developing device 208 according to the present embodiment, as shown in FIGS. 4 and 5, in order to prevent the creation of coarse-grained toner by the sliding friction between the non-driving side end surface 177*a* of the agitation support member 177 and the inner wall surface 176 of the toner container 131, a metallic pin (stepped pin) of good heat conductivity is used to form on the non-driving side end surface 177*a* of an agitation support member 177 a stepped surface 160 having a diameter larger than the aperture diameter of the bearing portion 137 of the toner container 131.

The toner feeding member 1 in the developing device 208 according to the present embodiment, as shown in FIGS. 4 and 5, uses a stepped pin 174 as a metallic pin, which is a support member fixed to the non-driving side end portion of the agitation support member 177. The diameter ϕd1 of the large-diametered portion 174*a* of the stepped pin 174 fixed to the non-driving side end portion of the agitation support member 177 is larger than the aperture diameter (diameter) ϕd5 of the bearing portion 137 of the toner container 131 supporting the small-diametered portion 174*b* of the stepped pin 174 and smaller than the length d2 of the shorter side of the elastic sheet seat surface 177*b* of the agitation support member 177, which provides a mounting seat for the elastic sheet member 3.

That is, the stepped pin 174 has its large-diametered portion 174*a* fixed to the non-driving side end surface 177*a* of the agitation support member 177 and has its small-diametered portion 174*b* supported by the bearing portion 137 of the toner container 131. The large-diametered portion 174*a* of the stepped pin 174 protrudes from the non-driving side end surface 177*a* of the agitation support member 177, whereby a stepped surface 160 having a diameter larger than the aperture diameter of the bearing portion 137 of the toner container 131 is formed on a portion of the non-driving side end surface 177*a* of the agitation support member 177. Accordingly, on the non-driving side of the agitation support member 177, a gap m corresponding to the protrusion length of the large-diametered portion 174*a* of the stepped pin 174 is formed between the non-driving side end surface 177*a* and the stepped surface 160.

Also, as regards the toner feeding member 1, the stepped surface 160 of the stepped pin 174 bears against the inner wall surface 176 around the bearing portion 137 of the toner container 131, whereby the longitudinal position regulation of the agitation support member 177 is done.

In the developing device 208 according to the present embodiment, even if the stepped surface 160 of the agitation support member 177 and the inner wall surface 176 of the toner container frictionally slide relative to each other, the heat radiation effect of that side of the frictionally sliding portion that is adjacent to the stepped pin 174 is great because the gap m is present between the stepped surface 160 and the non-driving side end surface 177*a* of the agitation support member 177. Therefore, the stepped pin 174 does not rise to a temperature which melts and secures the toner present near the bearing portion 137. Accordingly, the toner can be prevented from being melted and secured in the aforementioned frictionally sliding portion, and the creation of coarse-grained toner by the sliding frictional heat between the stepped surface 160 of the agitation support member 177 and the inner wall surface 176 of the toner container can be prevented.

Also, the longitudinal position regulation of the agitation support member 177 is effected by the stepped surface 160 of the stepped pin 174 and the inner wall surface 176 of the toner container 131. Therefore, as shown in FIG. 4, it becomes unnecessary to form on the transmitting shaft 163 and the agitation support member 177 the claw 152 of the driving side transmitting shaft 135 shown in Embodiment 1 and the dash portion 153 of the agitation support member 2 which is opposed thereto. Thus, it suffices to form only a fitting portion comprising a hole 177*c* for the transmitting shaft 163 to fit therein a drive transmitting keyway portion (not shown) in the driving side end portion of the agitation support member 177, and the driving side end portion can be made into a simple shape.

Also, the gap m is present between the stepped surface 160 and the non-driving end surface 177*a* of the agitation support member 177 and therefore, on the non-driving side of the agitation support member 177, the end portion 178 of the elastic sheet member 3 can be made into a straight shape up to substantially the same position as the stepped surface 160 (see FIG. 5). Thereby, a reduction in the toner agitating and carrying force in the inner end portion of the toner container on the non-driving side of the agitation support member 177 can be better prevented.

A modification of the developing device 208 according to the present embodiment will now be described with reference to FIGS. 6 and 7.

Figure 6:
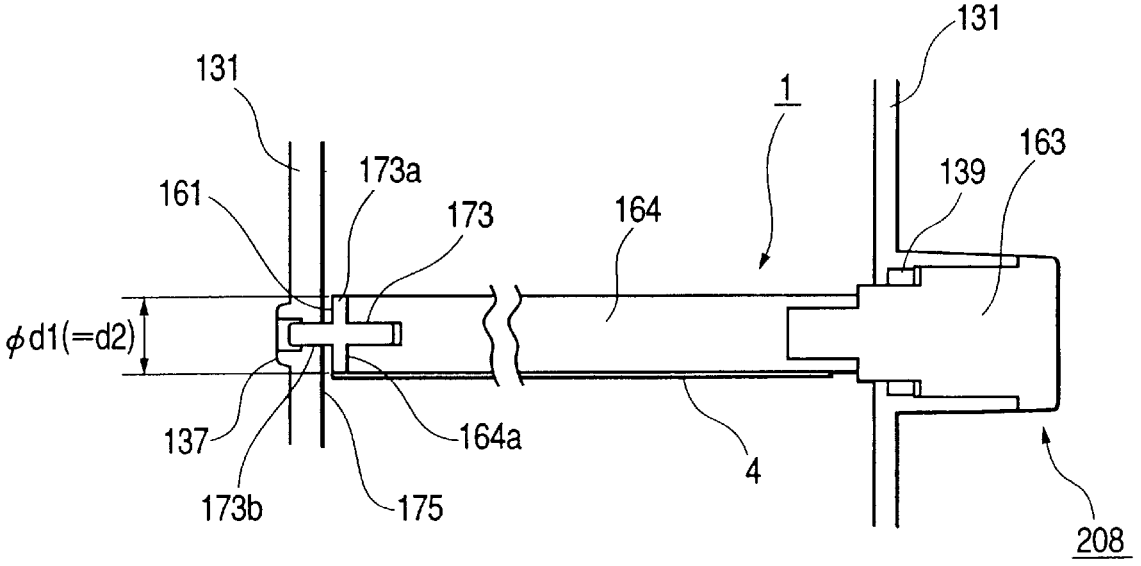
FIG. 6 is a cross-sectional view showing the construction of a modification of the toner agitating mechanism in the developing device according to Embodiment 2.
Figure 7:
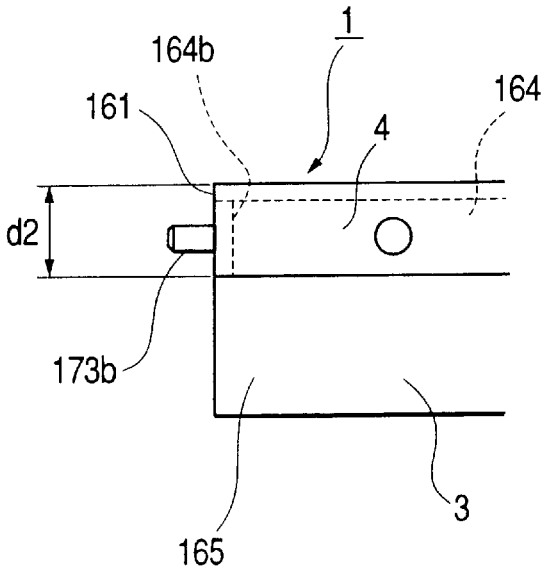
FIG. 7 is a front view of the non-driving side end portion of the agitation support member of the toner agitating mechanism shown in FIG. 6.

The developing device 208 shown in FIGS. 6 and 7 is the same in construction as the developing device 208 shown in FIGS. 4 and 5 with the exception that the diameter ϕd1 of the large-diametered portion 173*a* of a stepped pin 173 as a support member fixed to the non-driving side end portion of an agitation support member 164 is equal to the length d2 of the shorter side of the elastic sheet seat surface 164*b* of the agitation support member 164, which provides a mounting seat for the elastic sheet member 3.

That is, the stepped pin 173 has its large-diametered portion 173*a* fixed to the non-driving side end portion 164*a* of the agitation support member 164 and has its small-diametered portion 173*b* supported by the bearing portion 137 of the toner container 131. Thereby, the stepped pin 173 forms on the non-driving side end surface 164*a* of the agitation support member 164 a stepped surface 161 having a diameter larger than the aperture diameter of the bearing portion 137 of the toner container 131.

In the developing device 208 of such a construction, the non-driving side end surface 164*a* of the agitation support member 164 is covered with the stepped surface 161 of the large-diametered portion 173*a* of the stepped pin 173. Therefore, even if the stepped surface 161 of the agitation support member 164 and the inner wall surface 175 of the toner container frictionally slide relative to each other, the heat radiation effect of the stepped pin 173 side in the frictionally sliding portion is great. Therefore, the stepped pin 173 does not rise to a temperature that melts and secures the toner present near the bearing portion 175. Accordingly, the toner can be prevented from being melted and secured in the aforementioned frictionally sliding portion, and the creation of coarse-grained toner by the sliding frictional heat between the stepped surface 161 of the agitation support member 164 and the inner wall surface 175 of the toner container can be prevented.

Also, the non-driving side end surface 164*a* of the agitation support member 164 is covered with the stepped surface 161 of the large-diametered portion 173*a* of the stepped pin 173 and therefore, on the non-driving side of the agitation support member 164, the non-driving side end portion 165 of the elastic sheet member 3 can be straightly extended from the agitation support member 164 to the stepped surface 161 (see FIG. 7). Thereby, any reduction in the toner agitating and supplying force (feeding force) of the inner end portion of the toner container on the non-driving side of the agitation support member 164 can be better prevented.

Again in the developing device 208 wherein as described above, the metallic stepped pin 174, 173 is fixed to the non-driving side end portion of the agitation support member 177, 164, the creation of coarse-grained toner can be prevented at the developing step of the electrophotographic image forming process. Accordingly, the creation of a defective image in which coarse-grained toner is held between the elastic blade 107*a* and the developing sleeve 105 shown in FIG. 17 causing that portion to become a blank area in which the toner 109 is absent on the image can be prevented, and good image formation can be accomplished.

Embodiment 3

A developing device according to Embodiment 3 of the present invention will now be described.

The developing device according to the present embodiment is the same in construction as the developing device according to the aforedescribed Embodiment 1 except for the toner feeding member and the bearing portion of the toner container supporting the same. Accordingly, the developing device according to the present embodiment, like the developing device according to the aforedescribed Embodiment 1, is integrally coupled to the cleaning device to thereby constitute a process cartridge. This process cartridge is detachably mountable to the cartridge mounting means of the main body of the apparatus.

Figure 8:
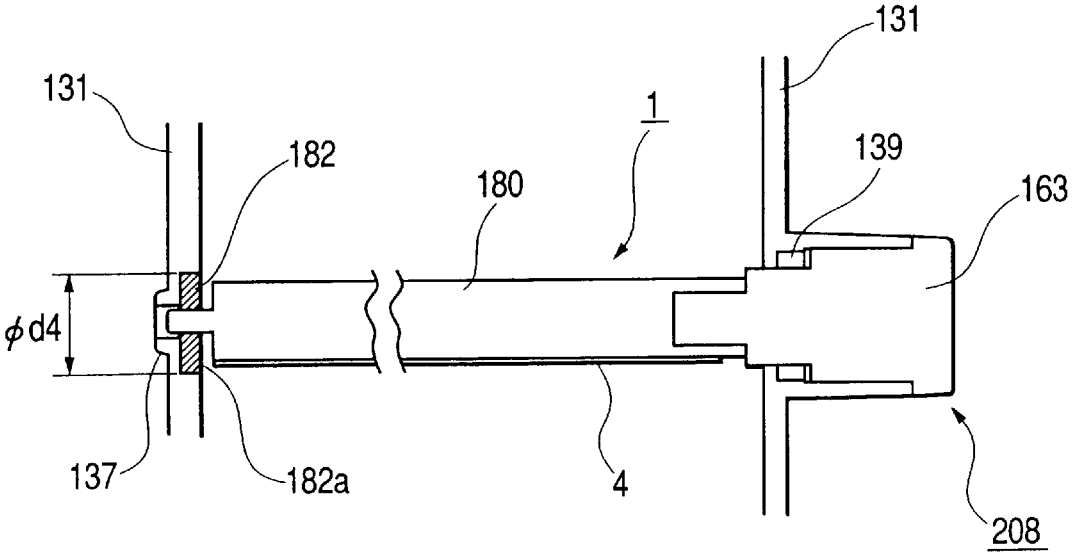
FIG. 8 is a cross-sectional view showing the construction of a toner agitating mechanism in a developing device according to Embodiment 3 of the present invention.
Figure 9:
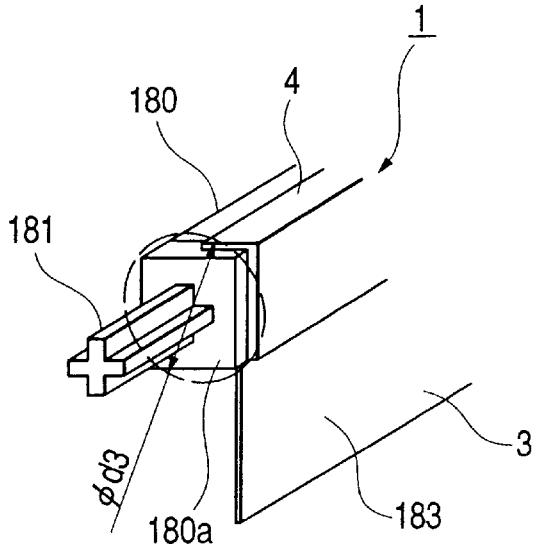
FIG. 9 is a perspective view of the non-driving side end portion of the agitating member of the toner agitating mechanism shown in FIG. 8.

FIGS. 8 and 9 show the construction of the bearing portion of the toner feeding member in the developing device according to the present embodiment.

In the developing devices 208 according to the aforedescribed Embodiments 1 and 2, a metallic pin having a high heat radiation effect is used as the supporting rotary shaft on the non-driving side of the agitation support member in order to prevent the creation of coarse-grained toner by the sliding friction between the supporting rotary shaft (support shaft) on the non-driving side of the agitation support member and the bearing portion of the toner container supporting the same, and the creation of coarse-grained toner by the sliding friction between the non-driving side end surface of the agitation support member and the inner wall surface of the toner container.

In the present embodiment, in order to prevent the creation of coarse-grained toner by the sliding friction between the supporting rotary shaft on the non-driving side of the agitation support member and the bearing portion of the toner container and to prevent the creation of coarse-grained toner by the sliding friction between the non-driving side end surface of the agitation support member and the inner wall surface of the toner container, as shown in FIG. 8, a supporting rotary shaft 181 as a support shaft (supporting portion) is molded integrally with an agitation support member 180 made of resin on the non-driving side of the agitation support member 180, and a metallic bearing (e.g. a sintered bearing) 182 having a high heat radiation effect is used as the bearing portion of the toner container 131 supporting the aforementioned supporting rotary shaft 181.

In the developing device 208 of such a construction, as shown in FIG. 9, the supporting rotary shaft 181 of the agitation support member 180 of the toner feeding member 1 is rotatably supported by the metallic bearing 182 in the bearing portion of the toner container 131.

In the developing device 208 shown in the present embodiment, the supporting rotary shaft 181 of the agitation support member 180 receives a driving force by a transmitting shaft 163 with the agitation support member 180 and is rotated, whereby the bearing 182 rotatably supporting the supporting rotary shaft 181 generates heat. However, the bearing 182 is high in heat conductivity as compared with the agitation support member 180 made of resin (plastic) and therefore, efficiently radiates sliding frictional heat generated by the driving rotation of the supporting rotary shaft 181. Therefore, the bearing 182 does not rise to a temperature that melts and secures the toner present near the supporting rotary shaft 181. Accordingly, the creation of coarse-grained toner by the sliding frictional heat of the bearing 182 by the supporting rotary shaft 181 of the agitation support member 180 being rotatively driven can be prevented.

Further, in the developing device 208 according to the present embodiment, as shown in FIGS. 8 and 9, the end surface diameter (diameter) ϕd4 of the bearing 182 is made equal to or larger than the rotation range diameter ϕd3 of the non-driving side end surface 180*a* of the agitation support member 180. Therefore, even if the non-driving side end surface 180*a* of the agitation support member 180 and the end surface 182*a* of the bearing 182 frictionally slide relative to each other, the bearing 182 does not rise to a temperature that melts and secures the toner present near the non-driving side end surface 180*a* of the agitation support member 180 because the heat radiation effect of the bearing 182 side in the frictionally sliding portion is great. Accordingly, the toner can be prevented from being melted and secured in the aforementioned frictionally sliding portion, and the creation of coarse-grained toner by the sliding frictional heat between the non-driving side end surface 180*a* of the agitation support member 180 and the end surface 182*a* of the bearing 182 can be prevented.

Also, the end surface diameter ϕd4 of the bearing 182 is made equal to or larger than the rotation range diameter ϕd3 of the non-driving side end surface 180*a* of the agitation support member 180, whereby as in the aforedescribed Embodiment 2, the non-driving side end portion 183 of the elastic sheet member 3 can be straightly extended from the agitation support member 180 to the non-driving side end surface 180*a* (see FIG. 8). Thereby, any reduction in the toner agitating and supply force (feeding force) of the inner end portion of the toner container on the non-driving side of the agitation support member 180 can be better prevented.

Again in the developing device 208 of a construction in which as described above, the support rotary shaft 181 of the agitation support member 180 made of resin (plastic) is supported by the use of the metallic bearing 182 having a high heat radiation effect, the creation of coarse-grained toner can be prevented at the developing step of the electrophotographic image forming process. Accordingly, the creation of a defective image, in which coarse-grained toner is held between the elastic blade 107*a* and the developing sleeve 105 shown in FIG. 17 and that portion becomes a blank area in which the toner 109 is absent on the image, can be prevented, and good image formation can be accomplished.

Embodiment 4

A developing device according to Embodiment 4 of the present invention will now be described.

The developing device according to the present embodiment is the same in construction as the developing device according to the aforedescribed Embodiment 1 except for the toner feeding member. Accordingly, the developing device according to the present embodiment, like the developing device according to the aforedescribed Embodiment 1, is integrally coupled to the cleaning device to thereby constitute a process cartridge. This process cartridge is detachably mountable to the cartridge mounting means of the main body of the apparatus.

Figure 10:
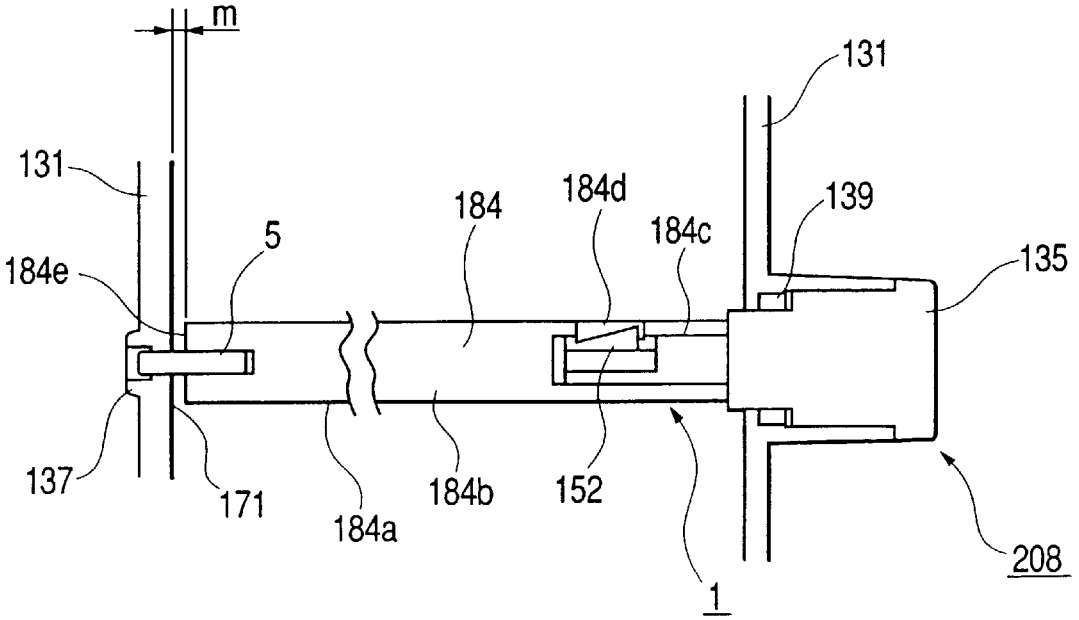
FIG. 10 is a cross-sectional view showing the construction of a toner agitating mechanism in a developing device according to Embodiment 4 of the present invention.
Figure 11:
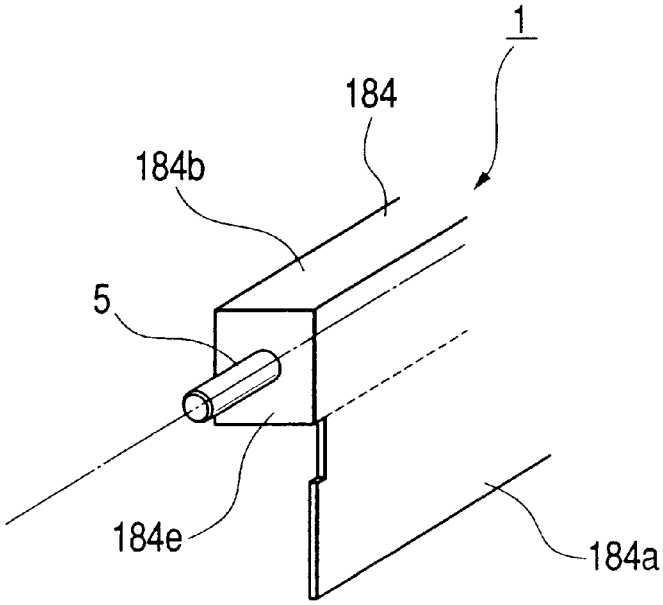
FIG. 11 is a perspective view of the non-driving side end portion of the agitating member of the toner agitating mechanism shown in FIG. 10.
Figure 12:
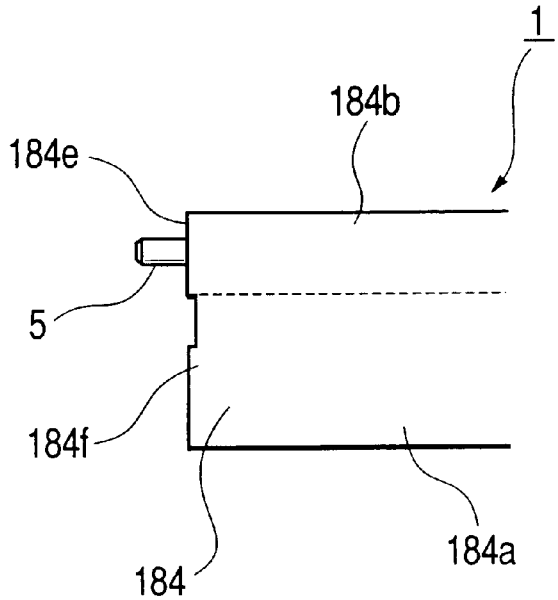
FIG. 12 is a front view of the non-driving side end portion of the agitating member of the toner agitating mechanism shown in FIG. 10.

FIGS. 10 to 12 show the construction of the toner feeding member in the developing device according to the present embodiment and the bearing portion thereof.

In the developing devices 208 according to the aforedescribed Embodiments 1, 2 and 3, the elastic sheet member 3 of the toner feeding member 1 is sandwiched between the agitation support member 2, 177, 164, 180 and the support plate 4.

In contrast, the toner feeding member 1 used in the developing device 208 according to the present embodiment, as shown in FIGS. 10 to 12, has an agitating member 184 in which an agitating portion 184*a* having the function of the elastic sheet member and an agitation support portion 184*b* supporting this agitating portion are made integral with each other by being extrusion-molded by the use of a plastic material.

A parallel pin 5 made of a metal (such as stainless steel or copper) as a support member is forced into and fixed to longitudinal one end portion, which is the non-driving side of the agitation support portion 184*b* constituting the agitating member 184. The pin shaft of this parallel pin 5 is supported by a bearing portion 137 provided on the toner container 131. Also, on the longitudinal other end portion, which is the driving side of the agitation support portion 184*b*, a transmitting shaft 135 as a drive transmitting member from the outside of the toner container 131 enters into a fitting portion comprising a fitting aperture 184*c* in the agitation support portion 184*b* and a drive transmitting keyway, not shown. Also, on the driving side of the agitation support portion 184*b*, a snap fit claw 152 provided on the transmitting shaft 135 is restrained on the dash aperture portion 184*d* of the agitation support portion 184*b* to thereby regulate the longitudinal position of the agitation support portion 184*b*. Thereby, on the non-driving side of the agitation support portion 184*b*, the non-driving side end surface 184*e* of the agitation support portion 184*b* and the inner wall surface 171 of the toner container around the bearing portion 137 of the toner container 131 do not frictionally slide relative to each other, and there is secured a predetermined gap m (0.5 mm or greater) that prevents the non-driving side end surface 184*e* of the agitation support portion 184*b* and the inner wall surface 171 of the toner container 131 from frictionally sliding relative to each other even if the tolences of the parts are accumulated.

In the developing device 208 of such a construction, a driving force is transmitted from the gear train of the already described process cartridge B to the transmitting shaft 135 of the agitating member 184 of the toner feeding member 1, and the transmitting shaft 135 transmits the driving force to the agitation support portion 184*b*. Thereby, in the toner container 131, the agitating portion 184*a* is rotated about a rotational axis linking the centers of the parallel pin 5 on the non-driving side and the transmitting shaft 135 on the driving side together to thereby agitate and carry the toner in the toner container 131 from the toner container to the development container.

During the agitation and feeding of the toner by the agitating portion 184*a*, the parallel pin 5 receives the driving force by the transmitting shaft 135 with the agitation support portion 184*b* in the bearing portion 137 of the toner container 131, and generates heat. The parallel pin 5, however, is high in heat conductivity as compared with the agitating portion 184 made of resin (plastic) and therefore efficiently radiates the sliding frictional heat with respect to the bearing portion 137 of the toner container 131. Therefore, the parallel pin 5 does not rise to a temperature that melts and secures the toner present near the bearing portion 137. Thus, the creation of coarse-grained toner by the sliding frictional heat of the parallel pin 5 with respect to the bearing portion 137 of the toner container 131 can be prevented.

Also, the parallel pin 5 is supported by the bearing portion 137 of the toner container 131 with a predetermined gap m secured between the non-driving side end surface 184*e* of the agitating member 184 and the inner wall surface 171 of the toner container 131. Thereby, the creation of coarse-grained toner by the sliding frictional heat between the non-driving side end surface 184*e* of the agitating member 184 and the inner wall surface 171 of the toner container 131 can be prevented.

Also, as shown in FIG. 10, the predetermined gap m is secured between the non-driving side end surface 184*e* of the agitating member 184 and the inner wall surface 171 of the toner container 131 and therefore, on the non-driving side of the agitating member 184, the end portion 184*f* of the agitating portion 184*a* can be made into a shape brought close to the vicinity of the inner wall surface 171 of the toner container (see FIG. 12). Thereby, the toner agitating and feeding force of the inner end portion of the toner container on the non-driving side of the agitating member 184 can be prevented from being reduced.

Again in the developing device 208 wherein as described above, the metallic parallel pin 5 is fixed to the non-driving side end portion of the agitation support portion 184*b* constituting the agitating member 184, the creation of coarse-grained toner can be prevented at the developing step of the electrophotographic image forming process. Accordingly, the creation of a defective image, in which coarse-grained toner is held between the elastic blade 107*a* and the developing sleeve 105 shown in FIG. 17 and that portion becomes a blank area in which the toner 109 is absent on the image, can be prevented, and good image formation can be accomplished.

While the developing device 208 according to the present embodiment uses the metallic parallel pin 5 as a support member, the metallic stepped pins 172, 174, 173 described in the modification of Embodiment 1, Embodiment 2 and the modification of Embodiment 2 can be used instead of the parallel pin 5 to thereby obtain an effect similar to the effects of the modification of Embodiment 1, Embodiment 2 and the modification of Embodiment 2.

Embodiment 5

A developing device according to Embodiment 5 of the present invention will now be described.

The developing device according to the present embodiment is the same in construction as the developing device according to the aforedescribed Embodiment 1 except for the toner feeding member and the bearing portion of the toner container supporting the same. Accordingly, the developing device according to the present embodiment, like the developing device according to the aforedescribed Embodiment 1, is integrally coupled to the cleaning device to thereby constitute a process cartridge. This process cartridge is detachably mountable to the cartridge mounting means of the main body of the apparatus.

Figure 13:
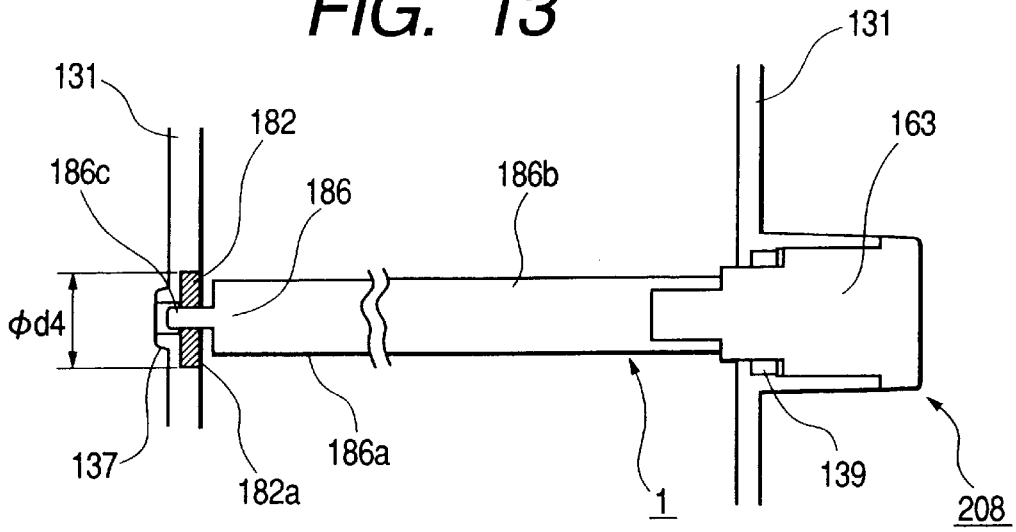
FIG. 13 is a cross-sectional view showing the construction of a toner agitating mechanism in a developing device according to Embodiment 5 of the present invention.
Figure 14:
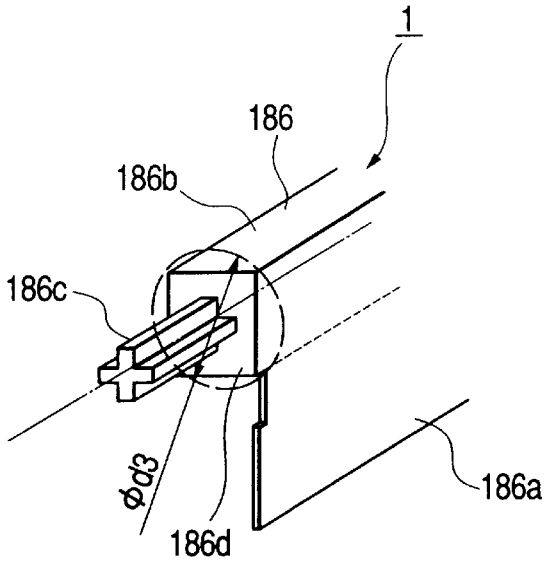
FIG. 14 is a perspective view of the non-driving side end portion of the agitating member of the toner agitating mechanism shown in FIG. 13.
Figure 15:
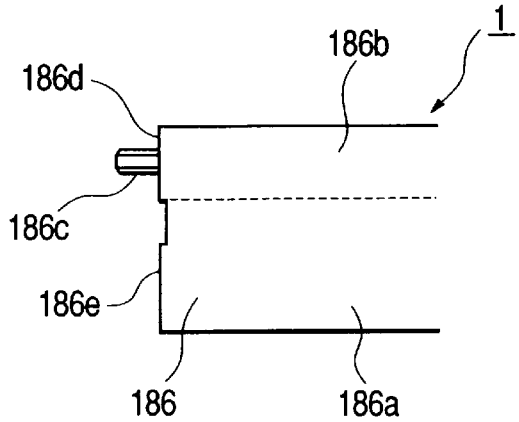
FIG. 15 is a front view of the non-driving side end portion of the agitating member of the toner agitating mechanism shown in FIG. 13.

FIGS. 13 to 15 show the construction of the toner feeding member in the developing device according to the present embodiment and the bearing portion thereof.

In the aforedescribed Embodiment 4, the toner feeding member 1 of the developing device 208 uses the agitating member 184 of a construction in which the agitating portion 184*a* and the agitation support portion 184*b* are made integral with each other.

In contrast, in the developing device 208 according to the present embodiment, as shown in FIGS. 13 to 15, the toner feeding member 1 uses an agitating member 186 of a construction in which an agitating portion 186*a* having the function of an elastic sheet member, an agitation support portion 186*b* supporting this agitating portion 186*a*, and a supporting rotary shaft 186*c*, which is the non-driving side supporting portion of this agitation support portion 186*b*, are extrusion-molded by a plastic material and are made integral with one another. Also, in the developing device 208 according to the present embodiment, a metallic bearing (e.g. a sintered bearing) 182 having a high heat radiation effect is used as the bearing portion of the toner container 131 supporting the supporting rotary shaft 186*c* of the agitating member 186.

In the developing device 208 of such a construction, as shown in FIG. 13, the supporting rotary shaft 186*c* of the agitation support portion 186*b* of the agitating member 186 constituting the toner feeding member 1 is rotatably supported by the metallic bearing 182 in the bearing portion of the toner container 131.

In the developing device 208 shown in the present embodiment, the supporting rotary shaft 186*c* of the agitating member 186 receives a driving force by a transmitting shaft 163 with the agitation support portion 186*b* and is rotated, whereby the bearing 182 rotatably supporting the supporting rotary shaft 186*c* generates heat. The bearing 182, however, is high in heat conductivity as compared with the agitating member 186 made of resin (plastic) and therefore efficiently radiates sliding frictional heat generated by the rotation of the supporting rotary shaft 186*c*. Therefore, the bearing does not rise to a temperature that melts and secures the toner present near the supporting rotary shaft 186*c*. Accordingly, the creation of coarse-grained toner, by the sliding frictional heat of the bearing 182 by the supporting rotary shaft 186*c* of the agitating member 186 being rotatively driven, can be prevented.

Further, in the developing device 208 according to the present embodiment, as shown in FIGS. 13 and 14, the end surface diameter (diameter) $\phi$d4 of the bearing 182 is made equal to or larger than the rotation range diameter ϕd3 of the non-driving side end surface 186*d* of the agitation support portion 186*b*. Thereby, even if the non-driving side end surface 186*d* of the agitation support member 186*b* and the end surface 182*a* of the bearing 182 frictionally slide relative to each other, the bearing 182 does not rise to a temperature that melts and secures the toner present near the non-driving side end surface 186*d* of the agitation support portion 186*b* because the heat radiation effect of the bearing 182 side in the frictionally sliding portion is great. Accordingly, the toner can be prevented from being melted and secured in the frictionally sliding portion, and the creation of coarse-grained toner, by the sliding frictional heat between the non-driving side end surface 180*a* of the agitation support portion 186*b* of the agitating member 186 and the end surface 182*a* of the bearing 182, can be prevented.

Also, the end surface diameter ϕd4 of the bearing 182 is made equal to or larger than the rotation range diameter ϕd3 of the non-driving side end surface 186*d* of the agitation support portion 186*b*, whereby as in the aforedescribed Embodiment 3, the non-driving side end portion 186*e* of the agitating portion 186*a* can be straightly extended from the agitation support member 186*b* to the non-driving side end surface 186*d* (see FIG. 15). Thereby, any reduction in the toner agitating and supplying force (feeding force) of the inner end portion of the toner container on the non-driving side of the agitation support portion 186*b* can be prevented.

Again in the developing device 208 of a construction in which as described above, the supporting rotary shaft 186*c* is formed integrally with the non-driving side end portion of the agitation support portion 186*b* constituting the agitating member 186 and the supporting rotary shaft 186*c* is supported by the use of the metallic bearing 182 having a high heat radiation effect, the creation of coarse-grained toner can be prevented at the developing step of the electrophotographic image forming process. Accordingly, the creation of a defective image, in which coarse-grained toner is held between the elastic blade 107*a* and the developing sleeve 105 shown in FIG. 17 and that portion becomes a blank area in which the toner 109 is absent on the image, can be prevented, and good image formation can be accomplished.

As described above, the following effects are obtained by the developing device according to the present embodiment:

1) the sliding frictional heat between the toner container and the supporting rotary shaft of the agitation support member, or between the toner container and the sliding portion of the supporting rotary shaft of the agitating member can be efficiently radiated to thereby eliminate the melting and securement of the toner and prevent the creation of coarse-grained toner;

2) the agitating member fixed to the agitation support member or the agitating portion of the agitating member can be extended to nearer to the inner surface of the toner container and as the result, it is possible to further widen the longitudinal agitating range of the toner feeding member.

While in the aforedescribed embodiments, as the agitating member or the agitating portion, a description has been provided, for example, of one having the feeding function of feeding the toner, in addition to the agitating function of agitating the toner as the developer, the agitating member or the agitating portion also includes one having only the agitating function.

In the aforedescribed developing device, the agitation support member receives a driving force from the drive transmitting member and is rotated about the support member and the drive transmitting member, whereby the agitating member agitates the developer in the developer container.

The support member receives a driving force by the drive transmitting member with the agitation support member and rotatively slides in the bearing portion of the developer container and generates heat, but the support member is made of a metal and therefore efficiently radiates the sliding frictional heat with respect to the bearing portion. Therefore, the support member does not rise to a temperature that melts and secures the developer present near the bearing portion, and consequently, the creation of coarse-grained developer by the sliding frictional heat between the support member and the bearing portion supporting the same can be prevented.

In the aforedescribed process cartridge, the agitation support member receives a driving force from the drive transmitting member and is rotated about the support member and the drive transmitting member, whereby the agitating member agitates the developer in the developer container.

The support member receives the driving force by the drive transmitting member with the agitation support member and rotatively slides in the bearing portion of the developer container and generates heat, but the support member is made of a metal and therefore efficiently radiates the sliding frictional heat with respect to the bearing portion. Therefore, the support member does not rise to a temperature that melts and secures the developer present near the bearing portion and consequently, the creation of coarse-grained developer by the sliding frictional heat between the support member and the bearing portion supporting the same can be prevented.

In the aforedescribed electrophotographic image forming apparatus, the agitation support member of the process cartridge receives a driving force from the drive transmitting member and is rotated about the support member and the drive transmitting member, whereby the agitating member agitates the developer in the developer container.

The support member receives a driving force by the drive transmitting member with the agitation support member and rotatively slides in the bearing portion of the developer container and generates heat, but the support member is made of a metal and therefore efficiently radiates the sliding frictional heat with respect to the bearing portion. Therefore, the support member does not rise to a temperature that melts and secures the developer present near the bearing portion and consequently, the creation of coarse-grained developer by the sliding frictional heat between the support member and the bearing portion supporting the same can be prevented.

In the aforedescribed agitation support member, the agitating member receives a driving force from the outside of the developer container by a fitting portion and is rotated about the support member and the fitting portion to thereby agitate the developer in the developer container.

The support member rotatively slides in the bearing portion of the developer container and generates heat, but the support member is made of a metal and therefore efficiently radiates the sliding frictional heat with respect to the bearing portion. Therefore, the support member does not rise to a temperature that melts and secures the developer present near the bearing portion and consequently, the creation of coarse-grained developer by the sliding frictional heat between the support member and the bearing portion supporting the same can be prevented.

In the aforedescribed agitating member, the agitating portion receives the drive force from the outside of the developer container by the fitting portion of the agitation support portion and is rotated about the support member and the fitting portion to thereby agitates the developer in the developer container.

The support member rotatively slides in the bearing portion of the developer container and generates heat, but the support member is made of a metal and therefore efficiently radiates the sliding frictional heat with respect to the bearing portion. Therefore, the support member does not rise to a temperature that melts and secures the developer present near the bearing portion and consequently, the creation of coarse-grained developer by the sliding frictional heat between the support member and the bearing portion supporting the same can be prevented.

Other Embodiments

In the aforedescribed Embodiments 1 to 5, there has been exemplified a case where the developing device is used in a process cartridge in which a developer container and a cleaning container or the like are made integral with each other, whereas the developing device according to the present invention need not be restricted thereto, but can also be suitably applied to a cartridge in which a toner container and a cleaner container for effecting toner recycle, or a toner container and a development container are made integral with each other.

Also, while the process cartridge shown in the aforedescribed embodiments has been exemplified with respect to a case where a monochromatic image is formed, the process cartridge according to the present invention can also be suitably applied to a cartridge in which a plurality of developing means are provided to thereby form an image of plural colors (e.g. a two-color image, a three-color image or a full color image or the like).

The electrophotographic photosensitive member is not restricted to the aforedescribed photosensitive drum, but covers the following. First, a photoconductor is used as the photosensitive member, and the photoconductor covers, for example, amorphous silicon, amorphous selenium, zinc oxide, titanium oxide and organic photoconductor (OPC). Also, a drum shape or a belt shape is used as the shape for carrying the photosensitive member thereon, and for example, in a drum type photosensitive member, a photoconductor is evaporated or applied onto a cylinder of an aluminum alloy or the like.

Also, as the developing method, use can be made of any one of various developing methods such as conventional two-component magnetic brush development, cascade development, touchdown development and cloud development.

Also, as regards the construction of the charging means, the so-called contact charging method is used in the aforedescribed embodiments, but it is a matter of course that as another construction, use may be made of a construction in which a metal shield, such as an aluminum alloy, is provided on three sides around a heretofore used tungsten wire and positive or negative ions produced by applying a high voltage to the tungsten wire are moved to the surface of a photosensitive drum to thereby uniformly charge the surface of the photosensitive drum.

As the charging means, use may be made of a blade (charging blade), a pad type one, a block type one, a rod type one, a wire type one or the like, besides the aforedescribed roller type one.

Also, as the cleaning method for the toner remaining on the photosensitive drum, a blade, a fur brush, a magnetic brush or the like may be used to constitute cleaning means.

Also, the aforedescribed process cartridge is provided, for example, with an electrophotographic photosensitive member and at least one of process means. Accordingly, the forms of the process cartridge include, besides the aforedescribed embodiments, for example, a form in which an electrophotographic photosensitive member and charging means are integrally made into a cartridge detachably mountable to the main body of the apparatus, a form in which an electrophotographic photosensitive member and developing means are integrally made into a cartridge detachably mountable to the main body of the apparatus, a form in which an electrophotographic photosensitive member and cleaning means are integrally made into a cartridge detachably mountable to the main body of the apparatus, and a form in which an electrophotographic photosensitive member and two or more of the process means are combined and integrally made into a cartridge detachably mountable to the main body of the apparatus.

That is, the aforedescribed process cartridge refers to charging means, developing means or cleaning means and an electrophotographic photosensitive member integrally made into a cartridge detachably mountable to the main body of an image forming apparatus, or at least one of charging means, developing means and cleaning means and an electrophotographic photosensitive member integrally made into a cartridge detachably mountable to the main body of the image forming apparatus, or at least developing means and an electrophotographic photosensitive member integrally made into a cartridge detachably mountable to the main body of the image forming apparatus. This process cartridge can be mounted and dismounted with respect to the main body of the image forming apparatus by a user himself. So, the maintenance of the main body of the apparatus can be done by the user himself.

Further, while in the aforedescribed embodiments, a laser beam printer is exemplified as the electrophotographic image forming apparatus, the present invention need not be restricted thereto, but the present invention can of course be also used in electrophotographic image forming apparatus such as an electrophotographic copier, a facsimile apparatus and a word processor.

As described above, according to the developing device according to the present invention, the creation of coarse-grained developer by the sliding frictional heat between the non-driving side end portion of the agitation support member and the bearing portion supporting the non-driving side end portion of the agitation support member can be prevented. Also, the creation of coarse-grained developer, by the sliding frictional heat between the non-driving side end portion of the agitation support portion of the agitating member and the bearing portion supporting the non-driving side end portion of the agitation support portion, can be prevented.

Also, according to the electrophotographic image forming apparatus according to the present invention, the creation of coarse-grained developer by the sliding frictional heat between the non-driving side end portion of the agitation support member of the process cartridge and the bearing portion supporting the non-driving side end portion of the agitation support member can be prevented. Also, the creation of coarse-grained developer, by the sliding frictional heat between the non-driving side end portion of the agitation support portion of the agitating member and the bearing portion supporting the non-driving side end portion, of the agitation support portion can be prevented.

Also, according to the agitation support member according to the present invention, the creation of coarse-grained developer, by the sliding frictional heat between the non-driving side end portion of the agitation support member and the bearing portion supporting the non-driving side end portion of the agitation support member, can be prevented.

Also, according to the agitating member according to the present invention, the creation of coarse-grained developer, by the sliding frictional heat between the non-driving side end portion of the agitation support portion of the agitating member and the bearing portion supporting the non-driving side end portion, of the agitation support portion can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A developing device for use in an electrophotographic image forming apparatus, said developing device comprising:

a developer container for containing therein a developer to be used for the development of an electrostatic latent image formed on an electrophotographic photosensitive member;

developing means for developing the electrostatic latent image formed on said electrophotographic photosensitive member by the developer;

an agitating member for agitating the developer contained in said developer container;

an agitation support member for supporting said agitating member;

a drive transmitting member for supporting one longitudinal end of said agitation support member on said developer container and driving said agitation support member; and a metallic support member for supporting the other longitudinal end of said agitation support member on a bearing portion of said developer container.

2. A developing device according to claim 1, wherein said agitating member is a sheet member.

3. A developing device according to claim 1, wherein a material of said agitation support member is resin.

4. A developing device according to claim 1, wherein said metallic support member is a parallel pin and is fixed to said agitation support member.

5. A developing device according to claim 1, wherein said metallic support member is a stepped pin and is fixed to said agitation support member.

6. A developing device according to claim 5, wherein a large-diametered portion of the stepped pin as said metallic support member is fixed to said agitation support member.

7. A developing device according to claim 5, wherein a large-diametered portion of the stepped pin as said metallic support member is fixed to said agitation support member and protrudes from a surface of the other end of said agitation support member.

8. A developing device for use in an electrophotographic image forming apparatus, said developing device comprising:

a developer container for containing therein a developer to be used for development of an electrostatic latent image formed on an electrophotographic photosensitive member;

developing means for developing the electrostatic latent image formed on said electrophotographic photosensitive member by the developer;

an agitating member integrally provided with an agitating portion for agitating the developer contained in said developer container, and an agitation support portion supporting said agitating portion, and disposed in said developer container;

a drive transmitting member for supporting one longitudinal end of the agitation support portion of said agitating member on said developer container and driving said agitating member; and a metallic support member for supporting the other longitudinal end of the agitation support portion of said agitating member on a bearing portion of said developer container.

9. A developing device according to claim 8, wherein the agitating portion of said agitating member is formed into a sheet shape.

10. A developing device according to claim 8, wherein a material of said agitating member is resin.

11. A developing device according to claim 8, wherein said metallic support member is a parallel pin and is fixed to said agitation support member.

12. A developing device according to claim 8, wherein said metallic support member is a stepped pin and is fixed to said agitation support member.

13. A developing device according to claim 12, wherein a large-diametered portion of the stepped pin as said metallic support member is fixed to said agitation support member.

14. A developing device according to claim 12, wherein a large-diametered portion of the stepped pin as said metallic support member is fixed to said agitation support member and protrudes from a surface of the other end of said agitation support member.

15. A developing device for use in an electrophotographic image forming apparatus, said developing device comprising:

a developer container for containing therein a developer to be used for development of an electrostatic latent image formed on an electrophotographic photosensitive member;

developing means for developing the electrostatic latent image formed on said electrophotographic photosensitive member by the developer;

an agitating member for agitating the developer contained in said developer container;

an agitation support member for supporting said agitating member and supporting one longitudinal end thereof on a bearing portion of said developer container;

a drive transmitting member for supporting the other longitudinal end of said agitation support member on said developer container and driving said agitation support member; and a metallic bearing member fixed to the bearing portion of said developer container and for supporting the other longitudinal end of said agitation support member.

16. A developing device according to claim 15, wherein said agitating member is a sheet member.

17. A developing device according to claim 15, wherein a material of said agitation support member is resin.

18. A developing device for use in an electrophotographic image forming apparatus, said developing device comprising:

a developer container for containing therein a developer to be used for development of an electrostatic latent image formed on an electrophotographic photosensitive member;

developing means for developing the electrostatic latent image formed on said electrophotographic photosensitive member by the developer;

an agitating member integrally provided with an agitating portion for agitating the developer contained in said developer container, an agitation support portion supporting said agitating portion, and a support portion supported by a bearing portion of said developer container on one longitudinal end of said agitation support portion, and disposed in said developer container;

a drive transmitting member for supporting the other longitudinal end of the agitation support portion of said agitating member and driving said agitating member; and a metallic bearing member fixed to the bearing portion of said developer container and for supporting the support portion of said agitating member.

19. A developing device according to claim 18, wherein the agitating portion of said agitating member is formed into a sheet shape.

20. A developing device according to claim 18, wherein a material of said agitating member is resin.

21. A developing device according to claim 18, wherein an end surface of said metallic bearing member which is adjacent to the support portion of said agitating member is larger than a maximum rotation diameter of a surface of the one end of the agitation support portion of said agitating member which is adjacent to said metallic bearing member.

22. A process cartridge detachably mountable to a main body of an electrophotographic image forming apparatus, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member for agitating the developer contained in said developer container;

an agitation support member for supporting said agitating member;

a drive transmitting member for supporting one longitudinal end of said agitation support member on said developer container and driving said agitation support member; and a metallic support member for supporting the other longitudinal end of said agitation support member on a bearing portion of said developer container.

23. A process cartridge according to claim 22, wherein said agitating member is a sheet member.

24. A process cartridge according to claim 22, wherein a material of said agitation support member is resin.

25. A process cartridge according to claim 22, wherein said metallic support member is a parallel pin, and is fixed to said agitation support member.

26. A process cartridge according to claim 22, wherein said metallic support member is a stepped pin, and is fixed to said agitation support member.

27. A process cartridge according to claim 26, wherein a large-diametered portion of the stepped pin as said metallic support member is fixed to said agitation support member.

28. A process cartridge according to claim 26, wherein a large-diametered portion of the stepped pin as said metallic support member is fixed to said agitation support member and protrudes from a surface of the other end of said agitation support member.

29. A process cartridge detachably mountable to a main body of an electrophotographic image forming apparatus, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member integrally provided with an agitating portion for agitating the developer contained in said developer container, and an agitation support portion supporting said agitating portion, and disposed in said developer container;

a drive transmitting member for supporting one longitudinal end of the agitation support portion of said agitating member on said developer container and driving said agitating member, and a metallic support member for supporting the other longitudinal end of the agitation support portion of said agitating member on a bearing portion of said developer container.

30. A process cartridge according to claim 29, wherein the agitating portion of said agitating member is formed into a sheet shape.

31. A process cartridge according to claim 29, wherein a material of said agitating member is resin.

32. A process cartridge according to claim 29, wherein said metallic support member is a parallel pin, and is fixed to said agitation support portion.

33. A process cartridge according to claim 29, wherein said metallic support member is a stepped pin, and is fixed to said agitation support portion.

34. A process cartridge according to claim 33, wherein a large-diametered portion of the stepped pin as said metallic support member is fixed to said agitation support portion.

35. A process cartridge according to claim 33, wherein a large-diametered portion of the stepped pin as said metallic support member is fixed to said agitation support member and protrudes from a surface of the other end of said agitation support portion.

36. A process cartridge detachably mountable to a main body of an electrophotographic image formed apparatus, said process cartridge comprising:

an electrophototopgraphic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member for agitating the developer contained in said developer container;

an agitation support member for supporting said agitating member, and supporting longitudinal end thereof on a bearing portion of said developer container;

a drive transmitting member for supporting the other longitudinal end of said agitation support member on said developer container and driving said agitation support member; and a metallic bearing member fixed to the bearing portion of said developer container and for supporting the one longitudinal end of said agitation support member.

37. A process cartridge according to claim 36, wherein said agitating member is a sheet member.

38. A process cartridge according to claim 36, wherein a material of said agitation support member is resin.

39. A process cartridge detachably mountable to a main body of an electrophotographic image forming apparatus, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member integrally provided with an agitating portion for agitating the developer contained in said developer container, an agitation support portion supporting said agitating portion, and a support portion supported by a bearing portion of said developer container on one longitudinal end of said agitation support portion, and disposed in said developer container;

a drive transmitting member for supporting the other longitudinal end of the agitation support portion of said agitating member and driving said agitating member; and a metallic bearing member fixed to the bearing portion of said developer container and for supporting the support portion of said agitating member.

40. A process cartridge according to claim 39, wherein the agitating portion of said agitating member is formed into a sheet shape.

41. A process cartridge according to claim 39, wherein a material of said agitating member is resin.

42. A process cartridge according to claim 39, wherein an end surface of said metallic bearing member which is adjacent to the support portion of said agitating member is larger than a maximum rotation diameter of a surface of the one end of the agitation support portion of said agitating member which is adjacent to said metallic bearing member.

43. A process cartridge according to claim 22, 29, 36 or 39, wherein at least one of charging means for charging said electrophotographic photosensitive member and cleaning means for removing any developer residual on said electrophotographic photosensitive member, said electrophotographic photosensitive member and said developing means are integrally made into a cartridge detachably mountable to the main body of said electrophotographic image forming apparatus.

44. An electrophotographic image forming apparatus for forming an image on a recording medium to which a process cartridge is detachably mountable, said electrophotographic image forming apparatus comprising:

(a) mounting means for detachably mounting said process cartridge, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member for agitating the developer contained in said developer container;

an agitation support member for supporting said agitating member;

a drive transmitting member for supporting one longitudinal end of said agitation support member on said developer container and driving said agitation support member; and a metallic support member for supporting the other longitudinal end of said agitation support member on a bearing portion of said developer container; and (b) conveying means for conveying said recording medium.

45. An electrophotographic image forming apparatus for forming an image on a recording medium to which a process cartridge is detachably mountable, said electrophotographic image forming apparatus comprising:

(a) mounting means for detachably mounting said process cartridge, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member integrally provided with an agitating portion for agitating the developer contained in said developer container, and an agitation support portion for supporting said agitating portion, and disposed in said developer container;

a drive transmitting member for supporting one longitudinal end of said agitation support portion of said agitating member on a bearing portion of said developer container and driving said agitation member; and a metallic bearing member for supporting the other longitudinal end of said agitation support portion of said agitating member on the bearing portion of said developer container; and (b) conveying means for conveying said recording medium.

46. An electrophotographic image forming apparatus for forming an image on a recording medium to which a process cartridge is detachably mountable, said electrophotographic image forming apparatus comprising:

(a) mounting means for detachably mounting said process cartridge, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member for agitating the developer contained in said developer container;

an agitation support member for supporting said agitating member and supporting one longitudinal end thereof on a bearing portion of said developer container;

a drive transmitting member for supporting the other longitudinal end of said agitation support member on said developer container and driving said agitation support member; and a metallic bearing member fixed to the bearing portion of said developer container and for supporting the one longitudinal end of said agitation support member; and (b) conveying means for conveying said recording medium.

47. An electrophotographic image forming apparatus for forming an image on a recording medium to which a process cartridge is detachably mountable, said electrophotographic image forming apparatus comprising:

(a) mounting means for detachably mounting said process cartridge, said process cartridge comprising:

an electrophotographic photosensitive member;

a developer container for containing therein a developer to be used for development of an electrostatic latent image formed on said electrophotographic photosensitive member;

developing means for developing the electrostatic latent image formed on said electrophotographic photosensitive member by the developer;

an agitating member integrally provided with an agitating portion for agitating the developer contained in said developer container, an agitation support portion supporting said agitating portion, and a support portion supported by a bearing portion of said developer container on one longitudinal end of said agitation support portion, and disposed in said developer container;

a drive transmitting member for supporting the other longitudinal end of the agitation support portion of said agitating member on said developer container and driving said agitating member; and a metallic bearing member fixed to the bearing portion of said developer container and for supporting the support portion of said agitating member; and (b) conveying means for conveying said recording medium.

48. An agitation support member for supporting an agitating member for agitating a developer in a developer container for containing therein the developer to be used for development of an electrostatic latent image formed on an electrophotographic photosensitive member, said agitation support member having on one longitudinal end thereof a fitting portion to which a drive force is transmitted from outside of said developer container, and having on the other longitudinal end thereof a metallic support member supported by a bearing portion of said developer container.

49. An agitation support member according to claim 48, wherein said agitating member is a sheet member.

50. An agitation support member according to claim 48, wherein a material of said agitation support member is resin.

51. An agitation support member according to claim 48, wherein said metallic support member is a parallel pin, and is fixed to said agitation support member.

52. An agitation support member according to claim 48, wherein said metallic support member is a stepped pin, and is fixed to said agitation support member.

53. An agitation support member according to claim 52, wherein a large-diametered portion of the stepped pin as said metallic support member is fixed to said agitation support member.

54. An agitation support member according to claim 52, wherein a large-diametered portion of the stepped pin as said metallic support member is fixed to said agitation support member and protrudes from a surface of the other end of said agitation support member.

55. An agitating member integrally provided with an agitating portion for agitating a developer in a developer container for containing therein the developer to be used for development of an electrostatic latent image formed on an electrophotographic photosensitive member, and an agitation support portion supporting said agitating portion, said agitation support portion having on one longitudinal end thereof a fitting portion to which a drive force is transmitted from outside of said developer container, and having on the other longitudinal end thereof a metallic support member supported by a bearing portion of said developer container.

56. An agitating member according to claim 55, wherein said agitating portion is of a sheet shape.

57. An agitating member according to claim 55, wherein a material of said agitating portion and said agitation support portion is resin.

58. An agitating member according to claim 55, wherein said metallic support member is a parallel pin, and is fixed to said agitation support portion.

59. An agitating member according to claim 55, wherein said metallic support member is a stepped pin, and is fixed to said agitation support portion.

60. An agitating member according to claim 59, wherein a large-diametered portion of the stepped pin as said metallic support member is fixed to said agitation support portion.

61. An agitating member according to claim 59, wherein a large-diametered portion of the stepped pin as said metallic support member is fixed to said agitation support portion and protrudes from a surface of the other end of said agitation support portion.

62. An agitation support member supporting an agitating member for agitating a developer in a developer container for containing therein the developer to be used for development of an electrostatic latent image formed on an electrophotographic photosensitive member, said agitation support member having on one longitudinal end thereof a fitting portion to which a drive force is transmitted from outside of said developer container, and being integrally provided on the other longitudinal end thereof with a support portion supported by a metallic bearing portion of said developer container.

63. An agitation support member according to claim 62, wherein said agitating member is of a sheet shape.

64. An agitation support member according to claim 62, wherein a material of said agitation support member is resin.

65. An agitating member integrally provided with an agitating portion for agitating a developer in a developer container for containing therein the developer to be used for development of an electrostatic latent image formed on an electrophotographic photosensitive member, and an agitation support member supporting said agitating portion, said agitation support member having on one longitudinal end thereof a fitting portion to which a drive force is transmitted from outside of said developer container, and being integrally provided on the other longitudinal end thereof with a support portion supported by a metallic bearing portion of said developer container.

66. An agitating member according to claim 65, wherein said agitating portion is formed into a sheet shape.

67. An agitating member according to claim 65, wherein a material of said agitating portion, said agitation support portion and said support portion is resin.

* * * * *

UNITED STATES PATENT AND TRADEMARK OFFICE

CERTIFICATE OF CORRECTION

PATENT NO. : 6,188,856 B1
DATED : February 13, 2001
INVENTOR(S) : Minoru Sato

It is certified that error appears in the above-identified patent and that said Letters Patent is hereby corrected as shown below:

Column 1,
Line 20, "the" should read -- the term --.

Column 4,
Line 17, "elec-trophotographic" should read -- electrophotographic --.

Column 21,
Line 5, "agitates" should read -- agitate --.

Column 30,
Line 5, "used for" should read -- used for containing therein the developer to be used for --.

Signed and Sealed this

Twenty-ninth Day of January, 2002

*Attest:*

*Attesting Officer*

JAMES E. ROGAN
*Director of the United States Patent and Trademark Office*